US008735701B2

(12) United States Patent
De Jule

(10) Patent No.: US 8,735,701 B2
(45) Date of Patent: May 27, 2014

(54) TONE CONTROL DEVICE FOR USE WITH A MUSICAL INSTRUMENT AND METHOD FOR MAKING THE SAME

(71) Applicant: Michael Clement De Jule, Clifton Park, NY (US)

(72) Inventor: Michael Clement De Jule, Clifton Park, NY (US)

( * ) Notice: Subject to any disclaimer, the term of this patent is extended or adjusted under 35 U.S.C. 154(b) by 0 days.

(21) Appl. No.: 13/765,262

(22) Filed: Feb. 12, 2013

(65) Prior Publication Data

US 2013/0145919 A1 Jun. 13, 2013

Related U.S. Application Data

(63) Continuation of application No. 12/710,643, filed on Feb. 23, 2010, now Pat. No. 8,399,758.

(51) Int. Cl.
*G10D 3/02* (2006.01)

(52) U.S. Cl.
USPC ..... 84/307; 84/294

(58) Field of Classification Search
USPC ..... 84/307
See application file for complete search history.

(56) References Cited

U.S. PATENT DOCUMENTS

| | | | | |
|---|---|---|---|---|
| 5,229,537 | A * | 7/1993 | Kennedy | 84/727 |
| 6,392,137 | B1 | 5/2002 | Isvan | |
| 6,875,910 | B2 | 4/2005 | Naimish | |
| 7,385,125 | B2 * | 6/2008 | Motsenbocker | 84/292 |
| 2002/0088331 | A1 | 7/2002 | Pecanic | |

OTHER PUBLICATIONS

Violin-Making A Historical and Practical Guide; Dover Publications, Inc., Mineola, NY; 2005; Title page Bibliographical Note page; pp. 128-129, 148-149, 160-161.

* cited by examiner

*Primary Examiner* — Christopher Uhlir
(74) *Attorney, Agent, or Firm* — Armstrong Teasdale LLP

(57) ABSTRACT

A tone control device is provided. The tone control device includes a weight assembly including at least a first magnet and a second magnet magnetically attracted to the first magnet, wherein the first magnet is positionable on a first surface of the bridge and the second magnet is positionable on a second surface of the bridge such that the weight assembly is securely coupled to the bridge.

19 Claims, 21 Drawing Sheets

TONE CONTROL DEVICE FOR USE WITH A MUSICAL INSTRUMENT AND METHOD FOR MAKING THE SAME

CROSS REFERENCE TO RELATED APPLICATIONS

This application is a continuation of U.S. patent application Ser. No. 12/710,643, filed Feb. 23, 2010, which is incorporated herein by reference in its entirety.

BACKGROUND OF THE INVENTION

The embodiments described herein relate generally to timbre and/or tone control devices for musical instruments and, more particularly, to devices for use with stringed instruments.

Over the past century or more, known attempts at improving string instruments in the violin family have generally failed or had only limited success. As such, known makers of instruments in the violin family have merely been copying early successful violin designs. As used herein, the "violin family" includes the classical violins, violas, cellos, double basses, and octobasses, as well as the "new violin family" that includes eight bowed string instruments referred to as the treble, soprano, mezzo, alto, tenor, baritone, small bass, and contrabass "fiddles." As used herein, the term "instrument" refers to an instrument in the violin family.

Currently, instrument body dimensions can be controlled accurately within a certain accuracy using known computer controlled carving machines. However, such machines only carve within a range of tolerance that makes operating such machines economically viable. Further, no two pieces of wood have the same physical properties, such as density, composition, and elasticity. As such, there is still a variation of tone from instrument to instrument, even when attempts are made to make the instruments identical using computer controlled carving machines.

Because no two instruments are identical, it is difficult, if not impossible, to grade good instruments on a scale of tone quality because each instrument differs slightly from any other instrument, both in frequency and relative loudness, while having a principle resonance that is substantially accurate. Although from an engineering viewpoint, physical differences between instruments may be small; seasoned musicians readily hear differences in tone among instruments. As used herein, the terms "tone," "timber," and "voicing" are used interchangeably to refer to a mixture of qualities of a sound produced by an instrument. Such sound qualities can include, but are not limited to only including, power, clarity, balance, evenness, warmth, richness, depth, smoothness, brilliance, responsiveness, edginess, resonance, and/or subjective qualities.

One of the lesser known voicing variables of an instrument is the bridge of the instrument. FIG. 1 is a front view of an exemplary known bridge 10 that may be used with a violin and/or a viola. In the exemplary embodiment, bridge 10 includes an upper portion 12, a waist 14, and a lower portion 16. Upper portion 12 extends between a crown 18 and waist 14 and includes a heart hole 20 defined therein and including a tonsil 22. Crown 18 includes a plurality of string notches 24 that are sized to retain a string (not shown) at a proper position. Waist 14 is defined by slits 26 and arm holes 28. Slits 26 and arm holes 28 also define outer arms 30, inner arms 32, and hands 34 of upper portion 12. Slits 26 and arm holes 28 also define bench bars 36 of lower portion 16. In the exemplary embodiment, lower portion 16 extends from waist 14 to a treble leg 38 and to a bass leg 40. Legs 38 and/or 40 may be formed as one piece with lower portion 16 or may be coupled to lower portion 16 at joints. Ankles 42 are formed between each leg 38 and/or 40 and bench bars 36. Bridge 10 has a first thickness (not shown) at crown 18 and a second thickness (not shown) at legs 38 and 40. The first thickness is smaller than the second thickness such that bridge widens from a top 44 to a bottom 46 of bridge 10. For example, in one embodiment, the first thickness is approximately 0.047 inches (in) (1.2 millimeters (mm)), and the second thickness is approximately 0.117 in (4.5 mm) for a known violin bridge.

FIG. 2 is a front view of another exemplary known bridge 50 that may be used with a cello and/or a bass. Bridge 50 is similar to bridge 10 (shown in FIG. 1), except a treble leg 52 and a bass leg 54 of bridge 50 are longer than legs 38 and 40 (shown in FIG. 1) of bridge 10. Further, legs 52 and 54 each include a projection 56 extending therefrom; however, it should be understood that legs 52 and/or 54 are not required to include projection 56. More specifically, bridge 50 includes an upper portion 58, a waist 60, and a lower portion 62. Upper portion 58 extends between a crown 64 and waist 60 and includes a heart hole 66 having a tonsil 68. Crown 64 includes a plurality of string notches 70 that are sized to retain a string (not shown) at a proper position. Waist 60 is defined by slits 72 and arm holes 74. Slits 72 and arm holes 74 also define outer arms 76, inner arms 78, and hands 80 of upper portion 58. Lower portion 62 extends from waist 60 to treble leg 52 and to bass leg 54. Feet 82 may be formed as one piece with legs 52 and/or 54, or feet 82 may be coupled to legs 52 and/or 54 at joints. Bridge 50 has a first thickness (not shown) at crown 64 and a second thickness (not shown) at legs 52 and 54. The first thickness is smaller than the second thickness such that bridge widens from a top 84 to a bottom 86 of bridge 50. For example, in one embodiment, the first thickness is approximately 0.12 in (3 mm), and the second thickness is approximately 0.42 in (10.7 mm) for a known cello bridge.

Because all sound produced by an instrument travels through the bridge, the bridge is a critical component in the voicing of the instrument. However, the bridge, once made, is fixed and unchangeable. As such, the voicing of the instrument is fixed by the bridge used on the instrument. At least some musicians attempt to change the voicing of their instruments by changing types and/or styles of bridges. However, such bridge modifications can be costly and time-consuming.

Many musicians also attempt to modify their instruments to produce a preferred voicing by, for example, moving a bridge or a soundpost of the instrument, searching for a preferred string and/or bow combinations, and/or using a mute on the bridge. The mute can be attached and removed during rests or breaks in a piece, but within known mutes, it is common for the mute to shift during playing.

Moreover, known mutes may be difficult to slide into and out of engagement with the instrument, may adversely affect the tone when not intended to rattle during playing, and/or may damage the strings.

BRIEF DESCRIPTION OF THE INVENTION

In one aspect, a tone control device is provided. The tone control device includes a weight assembly including at least a first magnet and a second magnet magnetically attracted to the first magnet, wherein the first magnet is securely positionable on a first surface of the bridge and the second magnet is positionable on a second surface of the bridge, such that the weight assembly is securely coupled to the bridge.

In another aspect, a musical instrument is provided. The musical instrument includes a bridge including an adjustment area. The bridge is configured to retain a plurality of strings of the musical instrument thereon. A weight assembly includes at least a first magnet and a second magnet magnetically coupled to the first magnet. The first magnet is positionable on a first surface of the bridge, and the second magnet is positionable on a second surface of the bridge such that the weight assembly is securely coupled to the bridge.

In yet another aspect, a musical instrument is provided. The musical instrument includes a bridge including an adjustment area. The bridge is configured to retain a plurality of strings of the musical instrument thereon. A weight assembly is securely coupled to the bridge. The adjustment area has a wide-band shape that enables the weight assembly to be moved horizontally and vertically with respect to the bridge.

In yet another aspect, a method is provided for making a tone control device for use with a musical instrument. The method includes positioning a first magnet on a first surface of a bridge, and positioning a second magnet on a second surface of the bridge such that the weight assembly is securely coupled to the bridge. The second magnet is magnetically attracted to the first magnet.

In yet another aspect, a method is provided for making a tone control device for use with a musical instrument. The method includes forming an adjustment area within a bridge blank. The bridge blank at least partially defines a body of a bridge. A weight assembly configured to be movable along the bridge to redistribute a weight of the bridge is provided. The adjustment area has a wide-band shape that enables the weight assembly to be moved horizontally and vertically with respect to the bridge.

BRIEF DESCRIPTION OF THE DRAWINGS

FIG. 1 is a front view of a known bridge that may be used with a violin and/or a viola.

FIG. 2 is a front view of a known bridge that may be used with a cello and/or a bass.

FIG. 3 is front view of an exemplary violin.

FIG. 4 is a perspective view of an exemplary cello.

FIG. 5 is a front view of an exemplary variable tone device that may be used with the violin shown in FIG. 3.

FIG. 6 is a side view of the violin variable tone device shown in FIG. 5.

FIG. 7 is a front view of an exemplary variable tone device that may be used with the cello shown in FIG. 4.

FIG. 8 is a side view of the cello variable tone device shown in FIG. 7.

FIG. 9 is a front view of a first alternative variable tone device that may be used with the violin shown in FIG. 3.

FIG. 10 is a front view of a second alternative variable tone device that may be used with the violin shown in FIG. 3.

FIG. 11 is a front view of a first alternative variable tone device that may be used with the cello shown in FIG. 4.

FIG. 12 is a front view of a third alternative variable tone device that may be used with the violin shown in FIG. 3.

FIG. 13 is a front view of a fourth alternative variable tone device that may be used with the violin shown in FIG. 3.

FIG. 14 is a front view of a second alternative variable tone device that may be used with the cello shown in FIG. 4.

FIG. 15 is a front view of a third alternative variable tone device that may be used with the cello shown in FIG. 4.

FIG. 16 is a front view of a fourth alternative variable tone device that may be used with the cello shown in FIG. 4.

FIG. 17 is a front view of a fifth alternative variable tone device that may be used with the cello shown in FIG. 4.

FIG. 18 is a side view of the variable tone device shown in FIG. 17.

FIG. 19 is a front view of a sixth alternative variable tone device that may be used with the cello shown in FIG. 4.

FIG. 20 is a front view of a seventh alternative variable tone device that may be used with the cello shown in FIG. 4.

FIG. 21 is a side view of the variable tone device shown in FIG. 20.

FIG. 22 is a front view of an eighth alternative variable tone device that may be used with the cello shown in FIG. 4.

FIG. 23 is a side view of a weight assembly that can be used with at least the variable tone device shown in FIG. 22.

FIG. 24 is a front view of a ninth alternative variable tone device that may be used with the cello shown in FIG. 4.

FIG. 25 is a side view of the variable tone device shown in FIG. 24.

FIG. 26 is a front view of a tenth alternative variable tone device that may be used with the cello shown in FIG. 4.

FIG. 27 is a front view of an eleventh alternative variable tone device that may be used with the cello shown in FIG. 4.

DETAILED DESCRIPTION OF THE INVENTION

Figure 1:
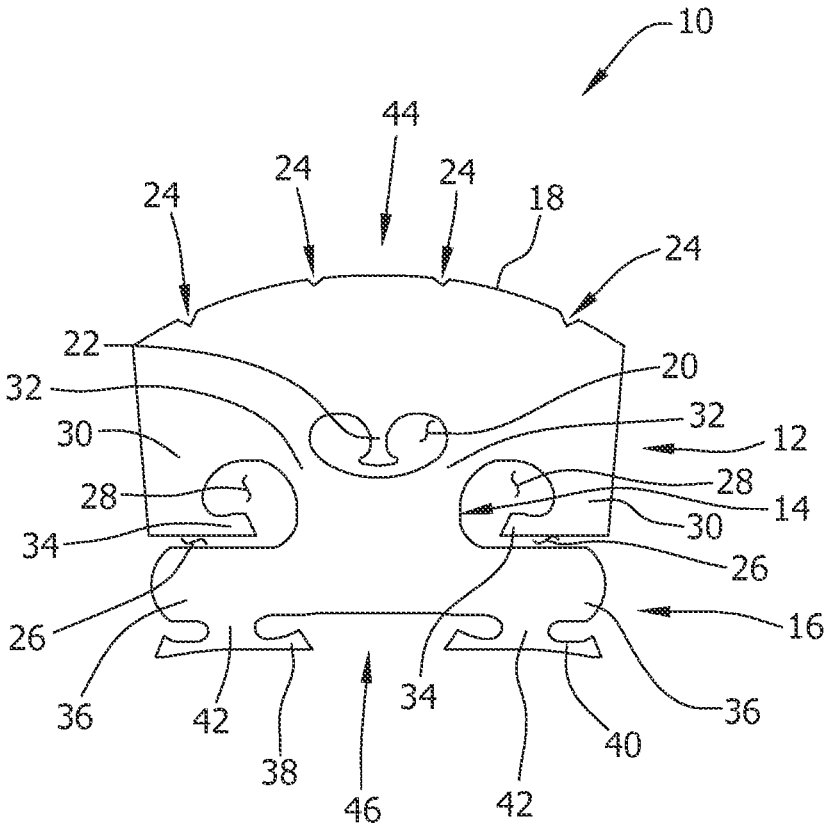
FIGS. 1-27 show exemplary embodiments of the devices and methods described herein.
Figure 2:
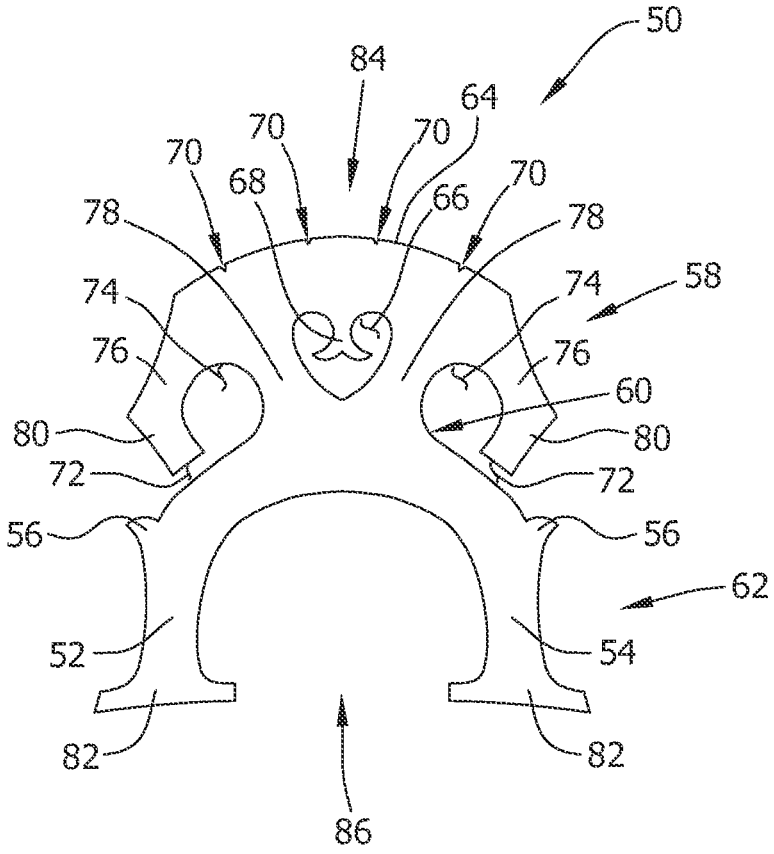

The embodiments described herein provide a variable tone device that can be used in place of a known bridge, as shown in FIGS. 1 and 2, for example, of an instrument. More specifically, the embodiments described herein allow a distribution of weight across a bridge to be adjusted using a weight assembly. Using the weight assembly, a top half of a bridge's inertia can be selectively varied by moving the attached weight assembly, thus changing the bridge's resonance frequency and changing the instrument's tone.

The variable tone device described herein enables a violin, viola, cello, or bass player to selectively adjust the tone of an instrument by moving weights that are attached to the instrument's bridge. At a higher weight position, the tone of the instrument is muted, mellow, and soft. At a lower weight position, the tone of the instrument is clearer, brighter, and louder. The weight can be positioned between the high and low positions to adjust a tone color and loudness of the instrument to an intermediate tone between muted-mellow-soft and the clearer-brighter-louder extremes. Such a characteristic of the embodiments described herein is referred to collectively as a "tone control adjustment" or a "tone-loudness-clarity control adjustment." Although all three of these musical qualities are influenced by moving the weight with respect to the bridge, for simplicity the embodiments described herein can be referred to as a "tone control bridge," a "tone color adjustment bridge," a "tone color control bridge," a "tuner bridge," a "voiced bridge," and/or a "voicing bridge," wherein the term "tone" refers to "tone-loudness-clarity."

As described herein, the weight assembly can include a pair of magnets attached to the bridge. By positioning the magnets higher on the bridge, the instrument's tone becomes mellower; and by positioning the magnets lower on the bridge, the instrument's tone becomes brighter. The magnets can easily be repositioned from a first location to a second location on the bridge with the musician's finger. To keep the musician from inadvertently pushing the magnets off of the bridge, at least one recess and/or slot is defined in the bridge. The recess and/or slot enables the player to move the magnets with respect to the bridge to adjust the instrument's tone or timber, but without enabling the magnets to be removed from the bridge.

As the magnets are repositioned within the recess and/or slot of the bridge, the bridge's rotational inertia or moment of inertia is selectively adjusted. For example, when the magnets are at the lowest position with respect to the bridge, a rotational inertia of the bridge is at its lowest value, which brightens the tone as if a very light standard bridge were attached to the instrument. In contrast, when the magnets are moved to the highest position with respect to the bridge, the rotational inertia of the bridge is at its highest value, which mellows the tone as if a very heavy standard bridge were attached to the instrument. Further, when heavier weights and/or magnets are attached to the bridge, the rotational inertia increases because of the increase in mass, and as such, the tone becomes mellower. Moreover, when the weights and/or magnets are heavy, the weights and/or magnets also act as a mute. Accordingly, an overall range of tone control can be from a very bright sound when the weight and/or magnets are in the lowest position, to a muted sound when heavy weight and/or magnets are in the highest position. To create a mute, such as a practice mute, the musician can attach additionally magnets to the initial pair of magnets coupled to the bridge. It contrast, a brightest and/or loudest tone can be achieved by removing the weights and/or magnets from the bridge. It should be understood, however, that only one pair of magnets and/or weights is needed for adequate tone control.

Additionally, at least some embodiments described herein enable the weight to be moved vertically, and also horizontally. For example, if the weight is moved directly under the treble strings, the treble strings sound mellower. Similarly, the tone changes when the weight is positioned under the bass strings.

The terms "violin" and "cello" are referred to below for the sake of simplicity, but it should be understood that the term "violin" can refer to violins and/or violas and the term "cello" can refer to cellos and/or basses.

Figure 3:
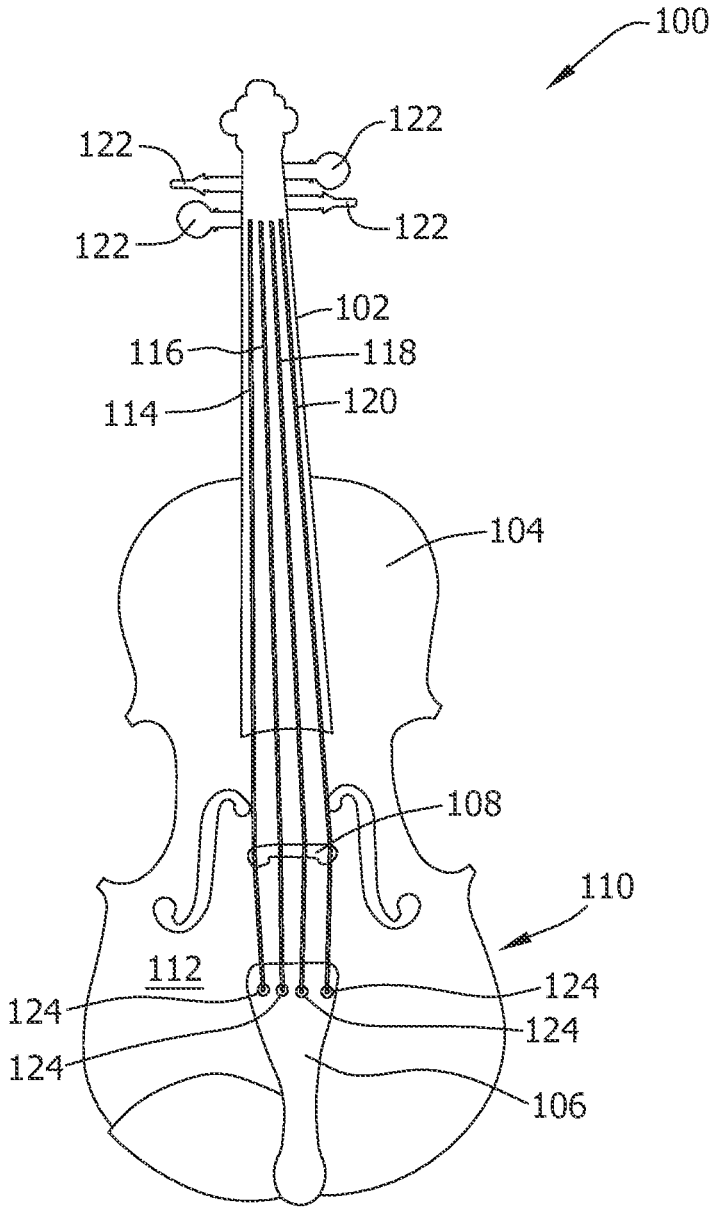

FIG. 3 is front view of an exemplary embodiment of a violin 100. In the exemplary embodiment, violin 100 includes a fingerboard 102, a belly 104, a tailpiece 106, and a bridge 108. Fingerboard 102 and tailpiece 106 are coupled to belly 104. Strings 114, 116, 118, and 120 are coupled to tailpiece 106, extended across bridge 108, and are coupled to fingerboard 102 at a respective tuning peg 122. String 114 is a G string, string 116 is a D string, string 118 is an A string, and string 120 is an E string. Tension in strings 114, 116, 118, and 120 retains bridge 108 against belly 104. An optional fine tuner 124 is coupled to at least one string 114, 116, 118, and/or 120 at tailpiece 106 to finely tune violin 100.

Figure 4:
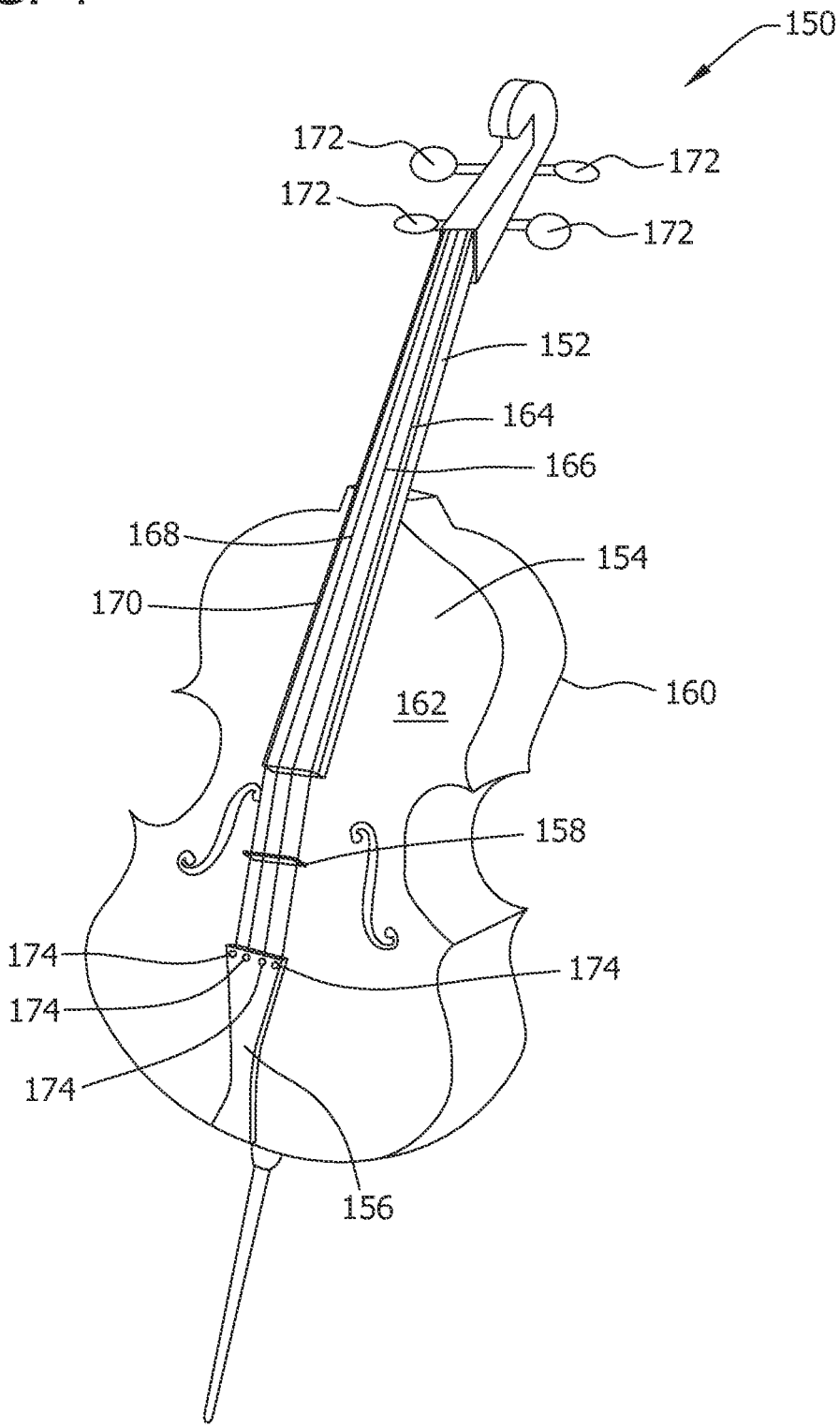

FIG. 4 is a perspective view of an exemplary embodiment of a cello 150. Cello 150 includes a fingerboard 152, a belly 154, a tailpiece 156, and a bridge 158. Fingerboard 152 and tailpiece 156 are coupled to belly 154. Strings 164, 166, 168, and 170 are coupled to tailpiece 156, extended across bridge 158, and are coupled to fingerboard 152 at a respective tuning peg 172. String 164 is an A string, string 166 is a D string, string 168 is a G string, and string 170 is a C string. Tension in strings 164, 166, 168, and 170 retains bridge 158 against belly 154. A fine tuner 174 is coupled to at least one string 164, 166, 168, and/or 170 at tailpiece 156 to finely tune cello 150.

Figure 5:
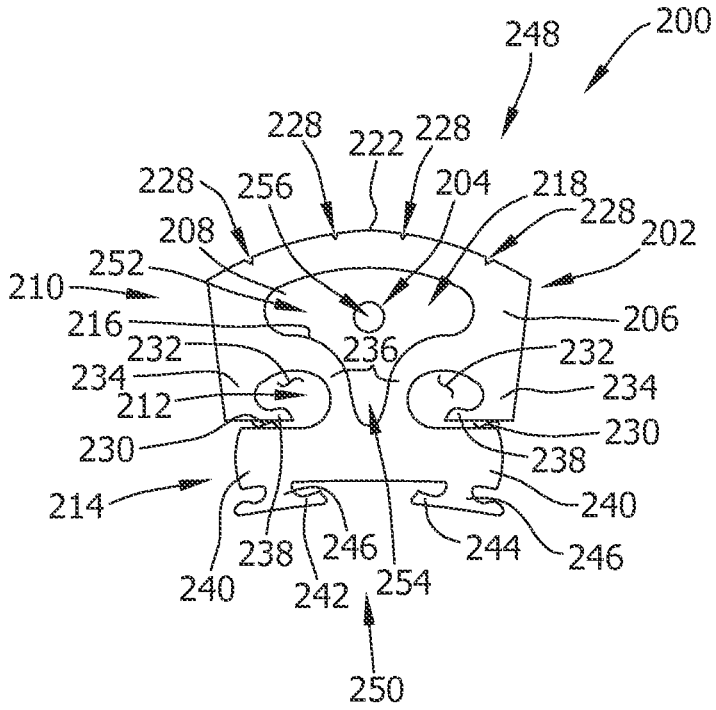
Figure 6:
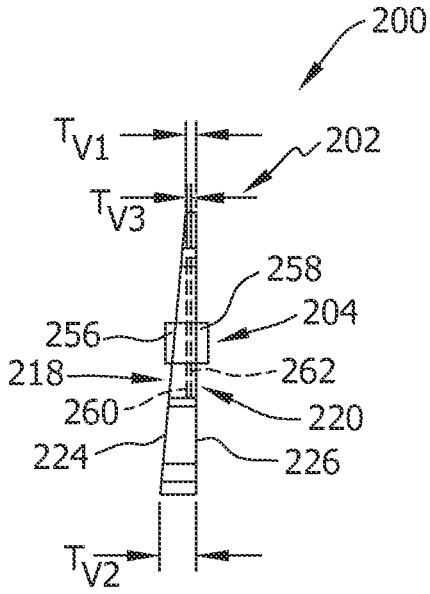

FIG. 5 is a front view of an exemplary embodiment of a variable tone device 200 that may be used with violin 100 (shown in FIG. 3) as bridge 108 (shown in FIG. 3). FIG. 6 is a side view of violin variable tone device 200. In the exemplary embodiment, violin variable tone device 200 includes a bridge 202 and a weight assembly 204. Bridge 202 includes a body 206 and an adjustment area 208. Body 206 is a unitary piece, and adjustment area 208 can be formed unitarily as one piece with body 206 or can be coupled to body 206. In the exemplary embodiment, bridge 202 is substantially similar to conventional violin bridges, but includes adjustment area 208 defined at a central portion of body 206. More specifically, in the exemplary embodiment, adjustment area 208 is located and/or sized to produce a substantially balanced bridge 202.

Body 206 includes an upper portion 210, a waist 212, and a lower portion 214. Body 206 also includes an inner edge 216 that circumscribes adjustment area 208. Inner edge 216 is defined by a recess 218 and/or 220. Upper portion 210 extends between a crown 222 and waist 212. Rather than including a heart hole and a tonsil, adjustment area 208 is positioned within upper portion 210 and waist 212, as described in more detail below. Adjustment area 208 includes a substantially flat piece of material that is formed unitarily with, or that is coupled to, body 206. Adjustment area 208 also includes a first recess 218 defined in a front surface 224 of bridge 202 and a second recess 220 defined in a back surface 226 of bridge 200. Alternatively, adjustment area 208 is substantially flush with one surface 224 or 226 of bridge 202 and only one recess 218 or 220, for example, is defined in bridge 202. Further, in the exemplary embodiment, recess 218 and/or 220 is substantially parallel to back surface 226.

Crown 222 includes a plurality of string notches 228 that are sized to retain a string at a proper position. Waist 212 is defined by slits 230 and arm holes 232. Slits 230 and arm holes 232 also define outer arms 234, inner arms 236, and hands 238 of upper portion 210. Slits 230 and arm holes 232 also define bench bars 240 of lower portion 214. Lower portion 214 extends from waist 212 to a treble leg 242 and to a bass leg 244. Legs 242 and/or 244 may be formed as one piece with lower portion 214 or may be coupled to lower portion 214 at joints. Ankles 246 are formed between each leg 242 and/or 244 and lower portion 214. Body 206 has a first thickness $T_{V1}$ at crown 222 and a second thickness $T_{V2}$ at legs 242 and 244, as shown in FIG. 6. First thickness $T_{V1}$ is smaller than second thickness $T_{V2}$ such that body 206 widens from a top 248 to a bottom 250 of bridge 202. Adjustment area 208 has a third thickness $T_{V3}$ that is substantially thinner than second thickness $T_{V2}$ and that is approximately equal to, or thinner than, first thickness $T_{V1}$. For example, in one embodiment, first thickness $T_{V1}$ is approximately 0.075 in (1.9 mm), second thickness $T_{V2}$ is approximately 0.2 in (5.2 mm), and third thickness $T_{V3}$ is approximately 0.050 in (1.3 mm).

In the exemplary embodiment, adjustment area 208 is shaped to generally correspond to a shape of body 206. More specifically, adjustment area 208 is sized and shaped to have an upper portion 252 that corresponds to upper portion 210 and a lower portion 254 that corresponds to waist 212. Such a shape may be referred to herein as a "wide-band" shape. Adjustment area 208 enables weight assembly 204 to be moved vertically and horizontally relative to bridge 202. Further, the thicker body material surrounding adjustment area 208 and defining recesses 218 and 220 facilitates preventing weight assembly 204 from being inadvertently removed from bridge 202 and/or to increase a total weight of bridge 202. The exemplary configuration of recess 218 and/or 220 and/or adjustment area 208 is described in more detail below. However, it should be understood that recess 218 and/or 220 and/or adjustment area 208 may have any suitable configuration that enables violin variable tone device 200 to function as described herein, including, without limitation, the configurations illustrated in FIGS. 9-27.

In the exemplary embodiment, weight assembly 204 includes a first magnet 256 and a second magnet 258 that are attracted to each other. Magnets 256 and 258 may also be referred to herein as "magnetic weights." During use, first magnet 256 is positioned on a front surface 260 or a rear surface 262 of adjustment area 208, and second magnet 258 is positioned on the opposite surface 260 or 262. Each magnet 256 and 258 magnetically attracts the other magnet 256 or 258 through adjustment area 208 to enable weight assembly 204 to be magnetically secured and/or coupled to bridge 202. In the exemplary embodiment, each magnet 256 and 258 is a neodymium magnet such that weight assembly 204 has a sufficient magnetic strength, while having a light enough weight that enable weight assembly 204 to function as described herein.

Figure 7:
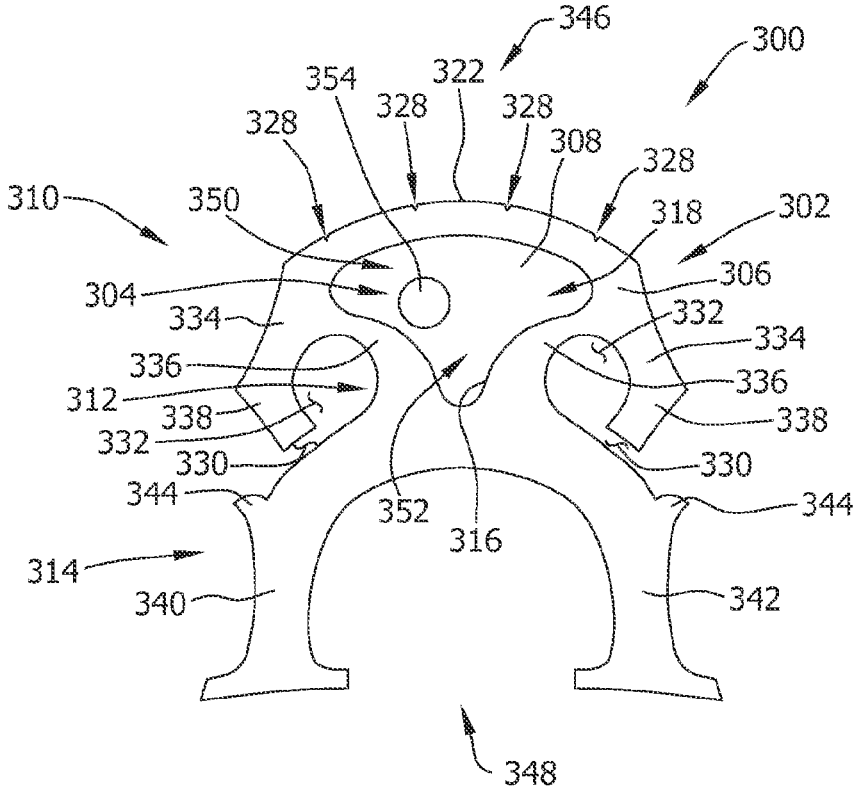
Figure 8:
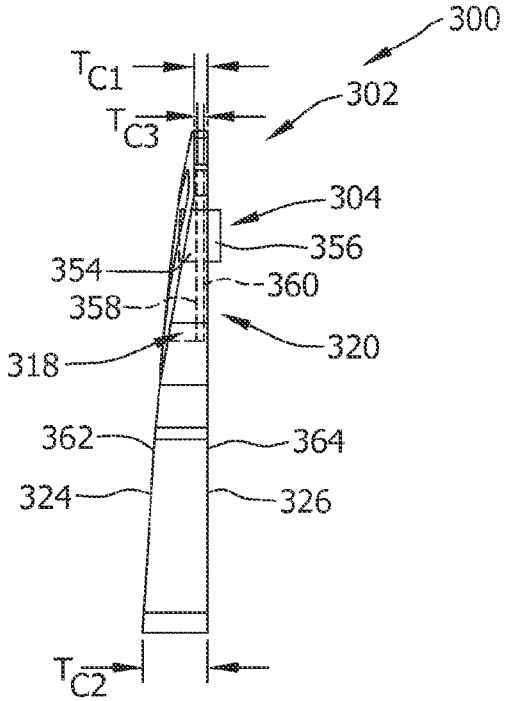

FIG. 7 is a front view of an exemplary variable tone device 300 that may be used with cello 150 (shown in FIG. 4) as bridge 158 (shown in FIG. 4). FIG. 8 is a side view of cello variable tone device 300. In the exemplary embodiment, cello variable tone device 300 includes a bridge 302 and a weight assembly 304. Bridge 302 includes a body 306 and an adjustment area 308. Body 306 is a unitary piece, and adjustment area 308 can be formed unitarily as one piece with body 306 or can be coupled to body 306. In the exemplary embodiment, bridge 302 is substantially similar to conventional cello bridges, but includes adjustment area 308 defined at a central portion of body 306. More specifically, in the exemplary embodiment, adjustment area 308 is located and/or sized to produce a substantially balanced bridge 302.

Body 306 includes an upper portion 310, a waist 312, and a lower portion 314. Body 306 also includes an inner edge 316 that circumscribes adjustment area 308. Inner edge 306 is defined by recesses 318 and/or 320. Upper portion 310 extends between a crown 322 and waist 312. Rather than including a heart hole and a tonsil, adjustment area 308 is positioned within upper portion 310 and waist 312, as described in more detail below. Adjustment area 308 includes a substantially flat piece of material that is formed unitary with or that is coupled to body 306. Adjustment area 308 also includes a first recess 318 defined in a front surface 324 of bridge 302 and a second recess 320 defined in a back surface 326 of bridge 302. Alternatively, adjustment area 308 is substantially flush with one surface 324 or 326 of bridge 302 and only one recess 318 or 320, for example, is defined in bridge 302. In the exemplary embodiment, recess 318 and/or 320 is parallel with back surface 326.

Crown 322 includes a plurality of string notches 328 that are sized to retain a string at a proper position. Waist 312 is defined by slits 330 and arm holes 332. Slits 330 and arm holes 332 also define outer arms 334, inner arms 336, and hands 338 of upper portion 310. Lower portion 314 extends from waist 312 to a treble leg 340 and to a bass leg 342. Legs 340 and/or 342 may be formed as one piece with lower portion 314 or may be coupled to lower portion 314 at joints. Legs 340 and 342 each include an optional projection 344 extending therefrom. Body 306 has a first thickness $T_{C1}$ at crown 322 and a second thickness $T_{C2}$ at legs 340 and 342, as shown in FIG. 8. First thickness $T_{C1}$ is smaller than second thickness $T_{C2}$ such that body 306 widens from a top 346 to a bottom 348 of body 306. Adjustment area 308 has a third thickness $T_{C3}$ that is substantially thinner than second thickness $T_{C2}$ and that is approximately equal to, or thinner than, first thickness $T_{C1}$. For example, in one embodiment, first thickness $T_{C1}$ is approximately 0.11 (2.8 mm), second thickness $T_{C2}$ is approximately 0.44 in (11.2 mm), and third thickness $T_{C3}$ is approximately 0.075 in (1.9 mm).

In the exemplary embodiment, adjustment area 308 is shaped to generally correspond to a shape of body 306. More specifically, adjustment area 308 is sized and shaped to have an upper portion 350 that corresponds to upper portion 310 and a lower portion 352 that corresponds to waist 312. Such a shape may be referred to herein as a "wide-band" shape. Adjustment area 308 enables weight assembly 304 to be moved vertically and horizontally relative to body 306. Further, the thicker body material surrounding adjustment area 308 and defining recesses 318 and 320 facilitates preventing weight assembly 304 from being inadvertently removed from bridge 302 and/or to increase a total weight of bridge 302. The exemplary configuration of recess 318 and/or 320 and/or adjustment area 308 is described in more detail below. However, it should be understood that recess 318 and/or 320 and/or adjustment area 308 may have any suitable configuration that enables cello variable tone device 300 to function as described herein, including, without limitation, the configurations illustrated in FIGS. 9-27.

Weight assembly 304 includes a first magnet 354 and a second magnet 356 that are attracted to each other. Magnets 354 and 356 may also be referred to herein as "magnetic weights." During use, first magnet 354 is positioned on a front surface 358 or a rear surface 360 of adjustment area 308, and second magnet 356 is positioned on the opposite surface 358 or 360. Each magnet 354 and 356 magnetically attracts the other magnet 354 or 356 through adjustment area 308 to enable weight assembly 304 to be magnetically secured and/or coupled to bridge 302. In the exemplary embodiment, each magnet 354 and 356 is a neodymium magnet such that weight assembly 304 has a sufficient magnetic strength, which having a light enough weight that enables weight assembly 304 to function as described herein.

Referring to FIGS. 5-8, bridge 202 and/or 302 is coupled to an instrument, for example, violin 100 (shown in FIG. 3) or cello 150 (shown in FIG. 4), using pegs (not shown). To prevent bridge 202 and/or 302 from bending when the pegs are tightened, bridge 202 and/or 302 is generally formed thicker than a conventional bridge. For example, in one embodiment, cello bridge 302 is tapered from the second thickness $T_{C2}$ of approximately 0.44 in at legs 340 and 342 to first thickness $T_{C1}$ of approximately 0.11 in (2.8 mm) at crown 322, as compared to 0.09 in (2.3 mm) or less for a conventional bridge crown. As such, an upper portion 310 is thicker in variable tone control devices 200 and 300 than in conventional bridges because conventional bridges commonly bend at upper portion 310 when the pegs are tightened.

However, in variable tone control devices 200 and 300, adjustment areas 208 and 308 are formed with thinner thickness $T_{V3}$ or $T_{C3}$ than the thicknesses of conventional bridges. For example, conventional thicknesses may be approximately 0.145 in (3.7 mm) at tonsil 22 (shown in FIG. 1), as compared to thickness $T_{V3}$ of approximately 0.05 in (1.3 mm) for violin bridge 202 of variable tone control device 200. In the exemplary embodiment, thickness $T_{V3}$ or $T_{C3}$ of adjustment area 208 and/or 308 is selected to facilitate increasing a force that magnets 256 and 258 and/or 354 and 356 induce across adjustment area 208 and/or 308. As such, magnets 256 and 258 and/or 354 and 356 are facilitated to be retained in position as bridge 202 and/or 302 vibrates. Because rear surface 262 or 360 of respective adjustment area 208 or 308 is substantially parallel to a respective front surface 260 or 358, magnets 256 and 258 and/or 354 and 356 are also inhibited from moving downwardly and/or to a thinner cross-sectional area of adjustment area 208 and/or 308 when bridge 202 and/or 303 vibrates.

It should be understood that thickness $T_{V3}$ or $T_{C3}$ of adjustment area 208 and/or 308 can vary through a wide range. For example, the thickness $T_{V3}$ or $T_{C3}$ of adjustment area 208 and/or 308 could be up to approximately 0.092 in (2.3 mm) or thicker provided that the magnetic field of magnets 256 and 258 and/or 354 and 356 is sufficiently strong to retain a selected position of magnets 256 and 258 and/or 354 and 356. It should also be understood that adjustment area 208 and/or 308 may also be formed thinner than 0.092 in (2.3 mm)

provided that adjustment area 208 and/or 308 is not easily broken or pierced. A value of 0.092 in (2.3 mm) for thickness $T_{V3}$ and/or $T_{C3}$ should not be considered to be an upper limit since thickness $T_{V3}$ and/or $T_{C3}$ is generally thick enough to support a downward force applied by the strings and thin enough to form an inner edge 216 and/or 316 to prevent accidentally removing weight assembly 204 and/or 304 from bridge 202 and/or 302 during adjustment of the tone.

In the exemplary embodiment, because bridge 202 and/or 302 is formed thicker than conventional bridges, adjustment area 208 and/or 308 is formed with a thickness that facilitates reducing a weight of bridge 202 and/or 302 such that an instrument sound is loud and bright when no magnetic weights 256 and 258 and/or 354 and 356 are attached to the instrument. Even without weight assembly 204 and/or 304, bridge 202 and/or 302 is novel as compared to conventional bridges because adjustment area 208 and/or 308 reduces the overall weight of bridge 202 and/or 302 while providing bridge 202 and/or 302 with enough static support for the strings and/or while preventing the arched crown 222 and/or 322 from collapsing. By using adjustment area 208 and/or 308 to reduce the weight of bridge 202 and/or 302, bridge 202 and/or 302 is easily set into motion by the much lower mass strings. Generally, the lower mass strings need assistance to set bridge 202 and/or 302 into vibration. In the exemplary embodiment, the lighter mass of bridges 202 and 302 thus responds quicker and is louder than conventional bridges.

Figure 11:
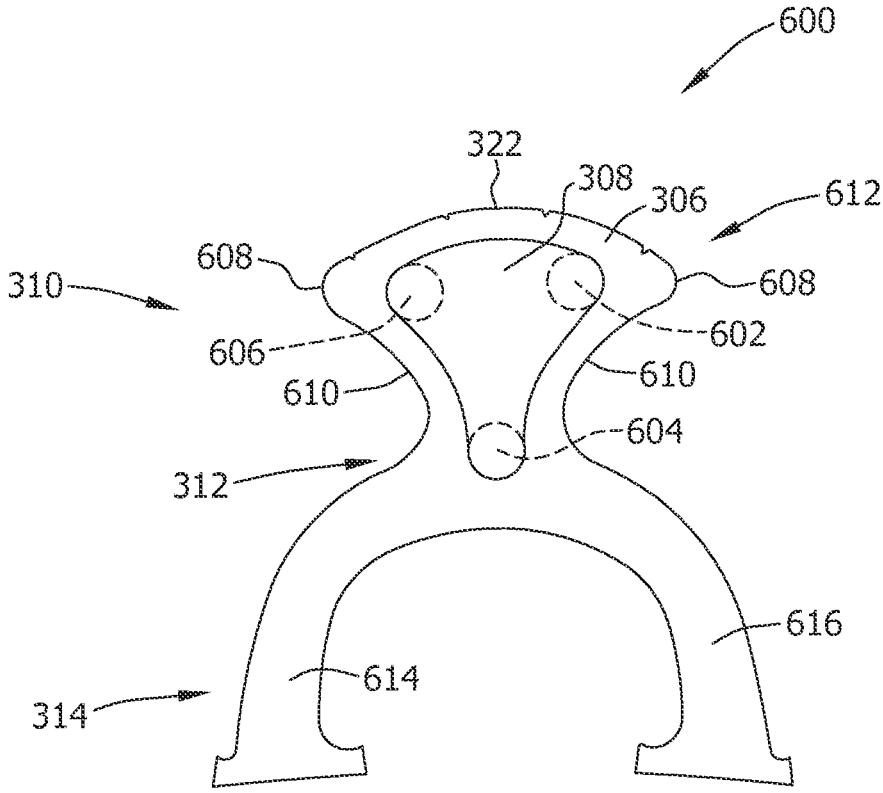

In the exemplary cello embodiment shown in FIG. 11, the weight of adjustment area 308 is between about 0.8 grams (g) and about 1.0 g, inclusive, and a total weight of bridge 612 is about 9.0 g to about 9.6 g, which includes adjustment area 308 and glue and/or fasteners used to attach adjustment area 308 to body 306. In one embodiment, to achieve the above-described weights, adjustment area 308 is formed with thickness $T_{C3}$ of about 0.075 in to about 0.080 in, and body 308 has crown thickness $T_{C1}$ of about 0.120 in and foot thickness $T_{C2}$ of about 0.410 in (10.4 mm). In the exemplary violin embodiment shown in FIGS. 5 and 6, adjustment area 208 is formed with thickness $T_{V3}$ of approximately 0.048 in. (1.2 mm), crown thickness $T_{V1}$ of approximately 0.075 in. (1.9 mm), and foot thickness $T_{V2}$ of approximately 0.205 (5.2 mm). The total weight of bridge 202 is 2.2 g, which includes adjustment area 208 and glue and/or fasteners to attach adjustment area 208 to body 206.

Still referring to FIGS. 5-8, the addition of outer arms 234 and/or 334 to bridge 202 and/or 302 provides several benefits. First, outer arms 234 and/or 334 provide bridge 202 and/or 302 with a conventional appearance without being a conventional bridge. The conventional appearance may make bridge 202 and/or 302 more desirable to very conservative musicians and/or to a conservative musical industry. Second, outer arms 234 and/or 334 cause the sound of the instrument to be mellower due to the added mass of outer arms 234 and/or 334. Moreover, outer arms 234 and/or 334 facilitate creating a more balanced bridge by removing a small amount of mass from the bass side outer arm to balance bridge 208 or 308 relative to a vertical line of symmetry. When bridge 208 and/or 308 is balanced, the instrument has a purer tone as compared to instruments having unbalanced bridges. However, as described below, outer arms 234 and/or 334 can be omitted and bridge 202 and/or 302 can still be balanced and function as described herein.

In the exemplary embodiment, magnets 256, 258, 354, and 356 are neodymium NEO35Ni magnets commercially available from Rochester Magnet Company of East Rochester, N.Y. Alternatively, magnets 256, 258, 354, and/or 356 may be formed from any suitable material that enables weight assembly 204 and/or 304 to function as described herein. However, neodymium ($Nd_2Fe_{14}B$) is optimal in some embodiments. More specifically, neodymium makes weight assembly 204 and/or 304 practical because it is currently the strongest type of permanent magnet that can be easily slid from spot to spot on bridge 202 and/or 302 with the nudge of a player's finger.

Referring to FIGS. 7 and 8, there are several possible methods that can be used to manufacture variable tone device 300. Although variable tone device 300 is referred to below for the sake of clarity, it should be understood that variable tone device 200 (shown in FIGS. 5 and 6) can be manufactured using any of the following methods. Further, the following methods may be performed manually, semi-manually, semi-automatically, or automatically, using any suitable tools and/or machines.

A first method includes coupling attachment area 308 to body 306. More specifically, an opening is formed in a bridge blank (not shown) to form body 306. A shape of the opening corresponds to a desired shape of adjustment area 308 and/or to recess 318 and/or 320. In the exemplary embodiment, the opening has a wide-band shape. The shape and size of the opening is transferred to an adjustment area blank by any suitable means, such as tracing. In one embodiment, an inside dimension of body 302, such as inner edge 316, is traced onto a thin flat piece of spotted maple Despiau bridge wood that is about 0.08 in (2 mm) thick (i.e. the adjustment area blank). In the exemplary embodiment, the adjustment area blank is then cut into a shape corresponding to the shape of the opening in body 306. Once cut, an insert that will become adjustment area 308 is formed. The insert may be sanded and/or hand-fitted to the opening defined in body 306.

The insert is inserted into the opening of body 306 and becomes adjustment area 308. In the exemplary embodiment, the insert is sized to have a friction fit within the opening. The insert is then coupled to body 306 using any suitable attachments means, such as adhesive. In the exemplary embodiment, the insert is coupled within the opening to define recesses 318 and 320. Alternatively, the insert is positioned within the opening such that a front surface of the insert is substantially flush with a front surface 362 of body 306 or such that a back surface of the insert is substantially flush with a back surface 364 of body 36. In the alternative embodiment, only recess 318 or 320 is defined in bridge 300. In the exemplary embodiment, weight assembly 304 can then be coupled to bridge 300 by positioning first magnet 354 against front surface 358 and positioning second magnet 356 against back surface 360 at a position that enables first magnet 354 to be magnetically coupled to second magnet 356 through adjustment area 308.

A second method for manufacturing bridge 302 includes forming adjustment area 308 unitarily with body 306. More specifically, in the exemplary embodiment, recess 318 is formed in a front surface of a bridge blank (not shown), such as a custom-made or commercially-available bridge blank, using a router, an end mill bit, and/or any other suitable tool or machine. When a commercially-available bridge is used to form bridge 302, the heart hole is filled with a wood insert before or after recess 318 and/or recess 320 is formed. In the exemplary embodiment, by forming recess 318, front surface 358 of adjustment area 308 is defined.

Second recess 320 is formed in a back surface of the bridge blank. Second recess 320 is formed with a similar shape and location as a shape of and location of first recess 318 on the front surface of the bridge blank. Second recess 320 is formed similarly to first recess 318 and defines back surface 360 of adjustment area 308. Recesses 318 and 320 are formed such that adjustment area 308 has a predetermined thickness $T_{C3}$, as described above. The material remaining about recesses 318 and 320 defines body 306, and edges of recess 318 and 320 define inner edge 316. Alternatively, bridge 302 only includes first recess 318 or second recess 320, but not both recesses 318 and 320. However, for safety it may be better to form both recesses 318 and 320 to ensure that magnets 354 and/or 356 cannot be inadvertently removed from bridge 302. In a particular embodiment, a template pattern is used to reproducibly and economically guide a bit during a manufacturing process.

Still referring to FIGS. 7 and 8, during use of variable tone device 300 the tone of the instrument can vary. Although variable tone device 300 is referred to below for the sake of clarity, it should be understood that variable tone device 200 (shown in FIGS. 5 and 6) can be similarly used. Variable tone device 300 enables a player to adjust the timber (tone color), loudness, and/or clarity of the instrument in a few sounds, for example, in as much time as it takes to attach a mute to the bridge, for example. Thus, a tone adjustment can be made between short, normal pauses in the music, similar to the timing for moving a mute onto and off a conventional bridge. In fact, one extreme position of weight assembly 304 functions similarly to a mute. During use, the player couples weight assembly 304 to bridge 302 by initially positioning first magnet 354 against front surface 358 of adjustment area 308 and then positioning second magnet 356 against back surface 360 of adjustment area 308. Alternatively, bridge 302 can be used without weight assembly 304.

When weight assembly 304 is coupled to bridge 302, the player moves weight assembly 304 towards top 346 of bridge 308 to mute the sound of the instrument. To make the sound louder, brighter, and clearer, the player moves weight assembly lower on bridge 302. To move weight assembly 304, the player only needs to slide one magnet 354 or 356 across adjustment area 308, and the other magnet 356 or 354 will automatically follow this movement as a result of the magnetic attraction. In the exemplary embodiment, it is also possible to move weight assembly 304 left or right across bridge 302. For example, positioning weight assembly 304 under the bass string will mute the bass sounds more than the treble sounds, and visa versa if weight assembly 304 is slid under the treble strings. Such movement of weight assembly 304 facilitates bass-treble tone control. In a particular embodiment, variable tone device 300 only allows for horizontal movement by having at least one recess shaped as a slot extending from under the bass string to under the treble string.

In the exemplary embodiment, variable tone device 300 enables vertical and horizontal displacement of the weight distribution of bridge 302 as magnetic weights 354 and 356 are selectively moved. The vertical displacement of weight assembly 304 creates a louder or softer sound, corresponding to a brighter or mellower (sweeter) sound as magnets 354 and 356 are moved downwardly and upwardly, respectively. The horizontal movement of weight assembly 304 dampens the treble strings or the bass strings. For example, on a cello, is the A string is rather loud, weight assembly 304 is displaced a little to the left. This dampens the loud A string to facilitate leveling the amplitude or "tone," as it is commonly referred to by musicians. FIG. 11 illustrates extreme positions of a weight assembly within an adjustment area as circles 602, 604, and 606. In the exemplary embodiment, once positioned, the magnetic attraction between magnets 354 and 356 is strong enough to enable magnets 354 and 356 to remain anchored in place even with vigorous playing and/or normal transportation by the player in a normal carrying case.

Figure 9:
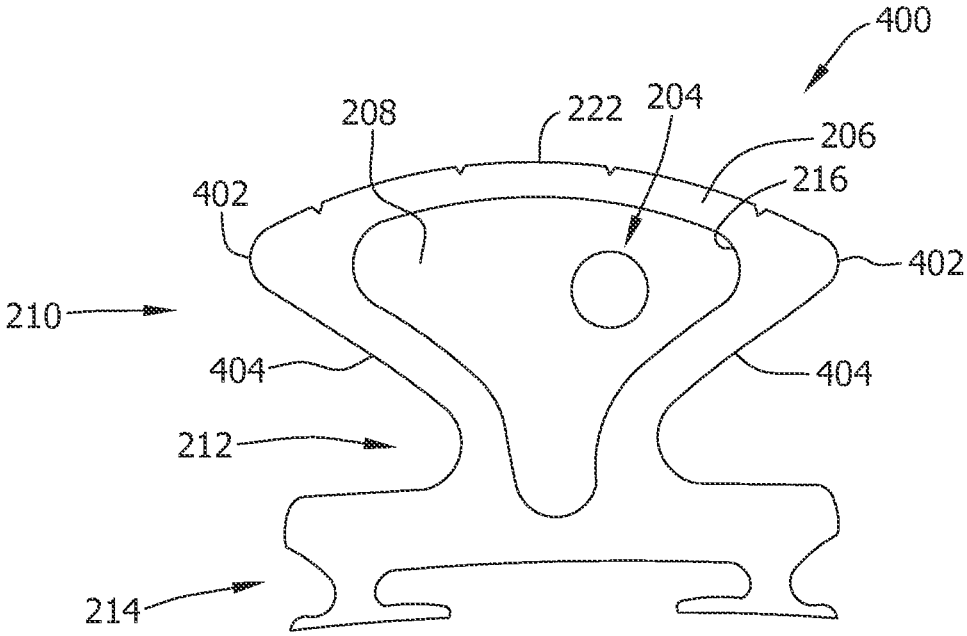

FIG. 9 is a front view of a first alternative violin variable tone device 400 that may be used with violin 100 (shown in FIG. 3) as bridge 108 (shown in FIG. 3). Unless otherwise described, violin variable tone device 400 includes components that are similar to the components described above with reference to violin variable tone device 200 (shown in FIGS. 5 and 6). More specifically, violin variable tone device 400 does not include outer arms 234 or hands 238 (shown in FIG. 5), but rather, violin variable tone device 400 includes rounded crown corners 402 and side edges 404. Side edges 404 taper from crown corners 402 towards waist 212 without defining any outer arms or hands. Some of the remaining embodiments, such as the embodiment shown in FIG. 9, do not include outer arms 334 and/or 234. It should be understood that the embodiments described herein can include outer arms to make the sound mellower due to the added mass. Thus, the absence or presence of outer arms on a bridge is compatible with any of the embodiments described herein.

Figure 10:
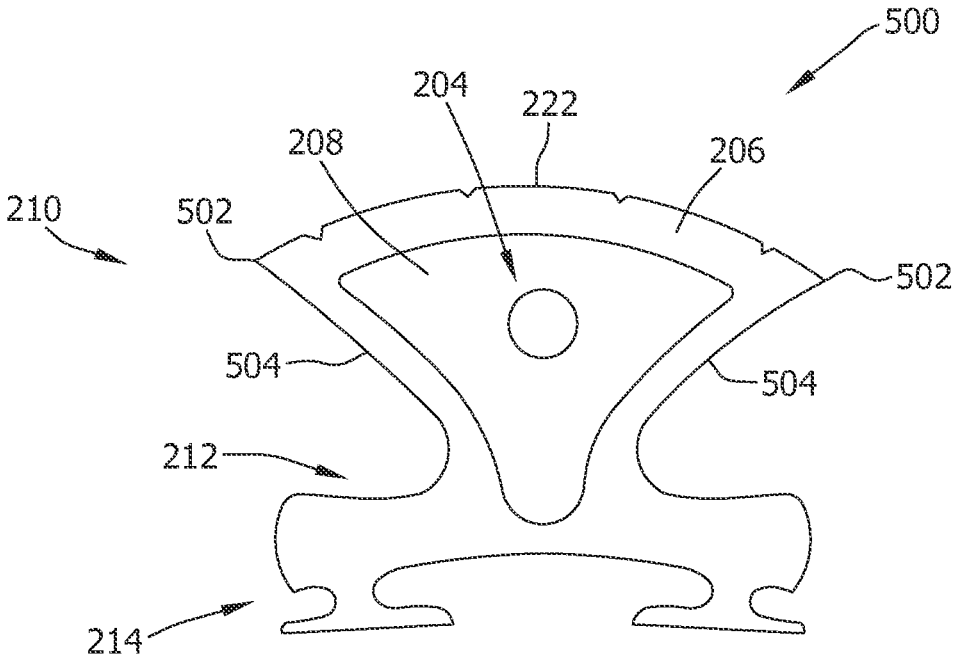

FIG. 10 is a front view of a second alternative violin variable tone device 500 that may be used with violin 100 (shown in FIG. 3) as bridge 108 (shown in FIG. 3). Unless otherwise described, violin variable tone device 500 includes components that are similar to the components described above with reference to violin variable tone device 200 (shown in FIGS. 5 and 6). More specifically, in the exemplary embodiment, violin variable tone device 500 does not include outer arms 234 or hands 238 (shown in FIG. 5), but rather, violin variable tone device 500 includes pointed or "sharp" crown corners 502 and side edges 504. Side edges 504 taper from crown corners 502 towards waist 212 without defining any outer arms or hands.

FIG. 11 is a front view of a first alternative cello variable tone device 600 that may be used with cello 150 (shown in FIG. 4) and bridge 158 (shown in FIG. 4). Unless otherwise described, cello variable tone device 600 includes components that are similar to the components described above with reference to cello variable tone device 300 (shown in FIGS. 7 and 8). More specifically, cello variable tone device 300 does not include outer arms 334 (shown in FIG. 5) or hands 338 (shown in FIG. 5), but rather, cello variable tone device 600 includes rounded crown corners 608 and side edges 610. Side edges 610 taper from crown corners 608 towards waist 312 without defining any arms or hands.

Further, in the exemplary embodiment, a bridge 612 includes "A"-frame style legs 614 and 616, rather than the more conventionally-styled legs 340 and 342 (shown in FIG. 7) of bridge 302 (shown in FIG. 7). As such, because the arching legs 614 and 616 being more rigid than conventionally-styled legs 340 and 342, bridge 612 may not vibrate left and right and/or up and down as easily as bridge 302. The up-down and/or left-right movement of a bridge may combine to cause the bridge to rotate along a somewhat elliptical path because two or more modes are vibrating simultaneously. More specifically, conventional cello bridges have been observed to vibrate left-right in addition to a rocking movement. A-frame style legs 614 and 616 can be substituted on bridge 302 for legs 340 and 342 and still be compatible with the embodiments described herein.

The alternative embodiments shown in FIGS. 12-27 include variations that are described in relation to either a violin bridge or a cello bridge. However, it should be understood that any of the variations described herein can be used with any of a violin bridge, a viola bridge, a cello bridge, and/or a bass bridge and is not limited to being used with a cello and/or a violin. Further, it should be understood that any of the variations described herein can be used individually or in combination with the above-described embodiments and/or any other variation.

Figure 12:
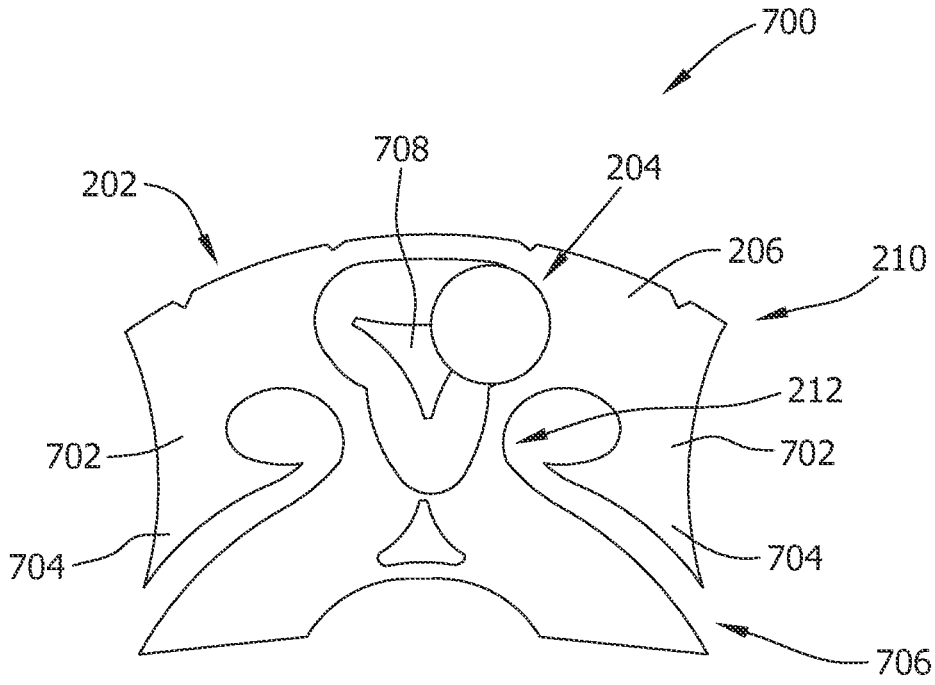

FIG. 12 is a front view of a third alternative violin variable tone device 700 that may be used with violin 100 (shown in FIG. 3) as bridge 108 (shown in FIG. 3). Unless otherwise described, violin variable tone device 700 includes components that are similar to the components described above with reference to violin variable tone device 200 (shown in FIGS. 5 and 6). More specifically, violin variable tone device 700 includes outer arms 702, hands 704, and lower portion 706 that are each shaped differently than respective outer arms 234 (shown in FIG. 5), hands 238 (shown in FIG. 5), and lower portion 214 (shown in FIG. 5). Further, adjustment area 208 includes an aperture 708 defined therethrough. Aperture 708 is formed with any suitable shape that enables violin variable tone device 700 to function as described herein. In the exemplary embodiment, outer arms 702, hands 704, lower portion 706, and/or aperture 708 are designed to achieve a desired tone that is similarly produced by using bridge 202, but with a mellower tone due to the larger mass of outer arms 704.

Figure 13:
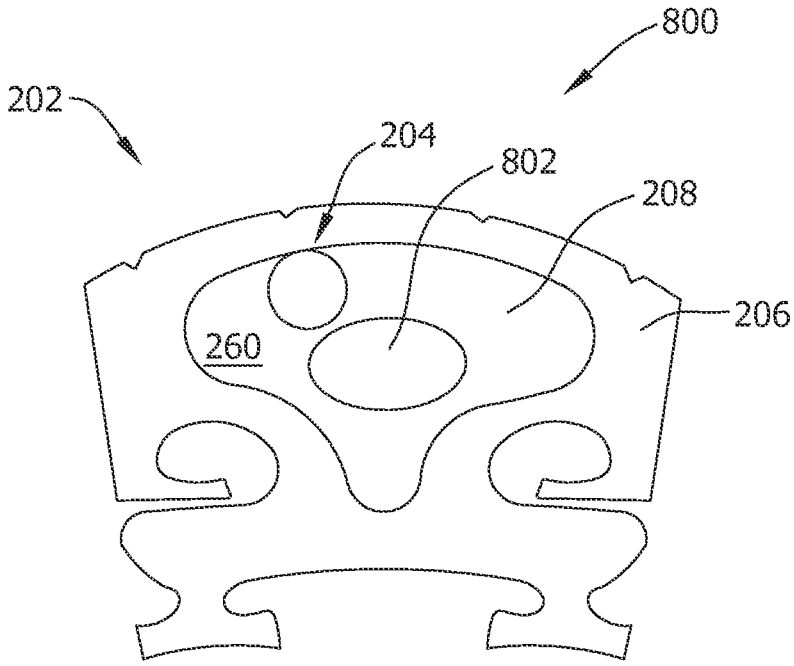

FIG. 13 is a front view of a fourth alternative violin variable tone device 800 that may be used with violin 100 (shown in FIG. 3) as bridge 108 (shown in FIG. 3). Unless otherwise described, violin variable tone device 800 includes components that are similar to the components described above with reference to violin variable tone device 200 (shown in FIGS. 5 and 6). More specifically, violin variable tone device 800 includes an insert 802 that is positioned within adjustment area 208. During manufacturing, it may be advantageous to modify a conventional bridge and convert it to tone control device 800. This requires that heart hole 20 (shown in FIG. 1) be filled with wood to prevent weight assembly 204 from catching on and/or falling into heart hole 20. To modify the convention bridge, tonsil 22 (shown in FIG. 1) is removed and the resulting hole is elliptically shaped as shown in FIG. 13. A wood plug, such as insert 802, is then made into the shape of the ellipse and glued into the elliptical hole. Thus, heart hole 20 and tonsil 22 of the conventional bridge is filled with the wood plug in the shape of elliptical insert 802. Insert 802 increases a total weight of bridge 202 and/or guides weight assembly 204 within adjustment area 208.

Figure 14:
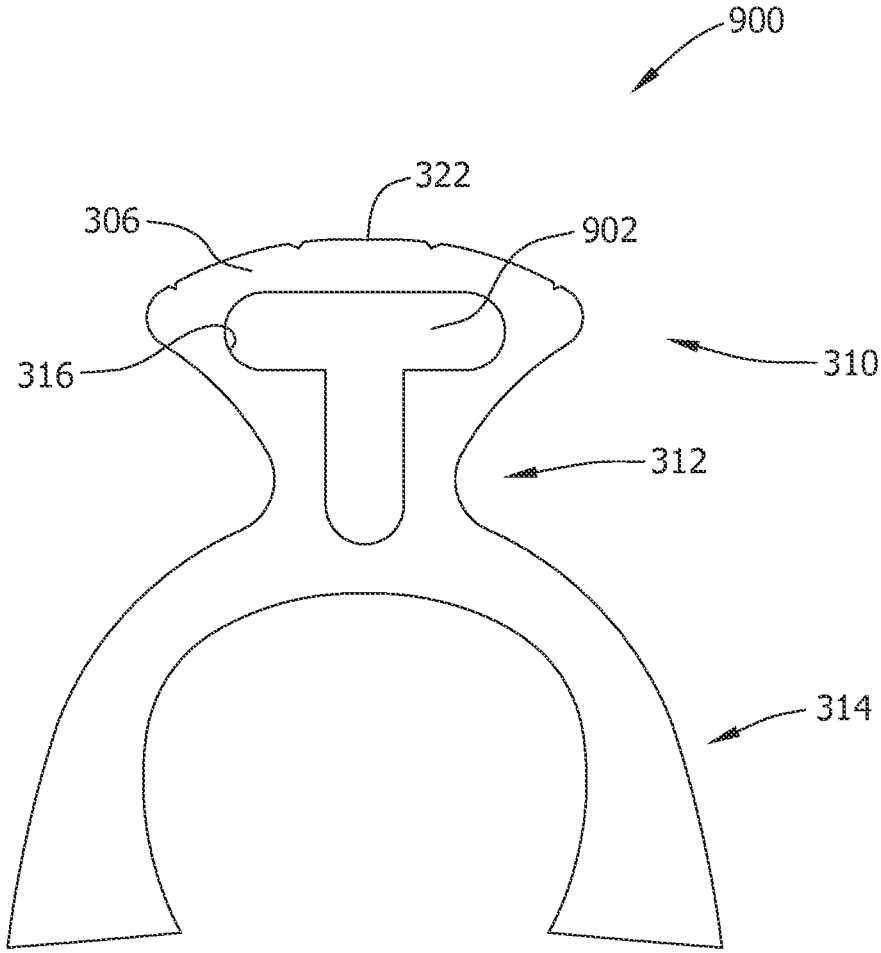
Figure 15:
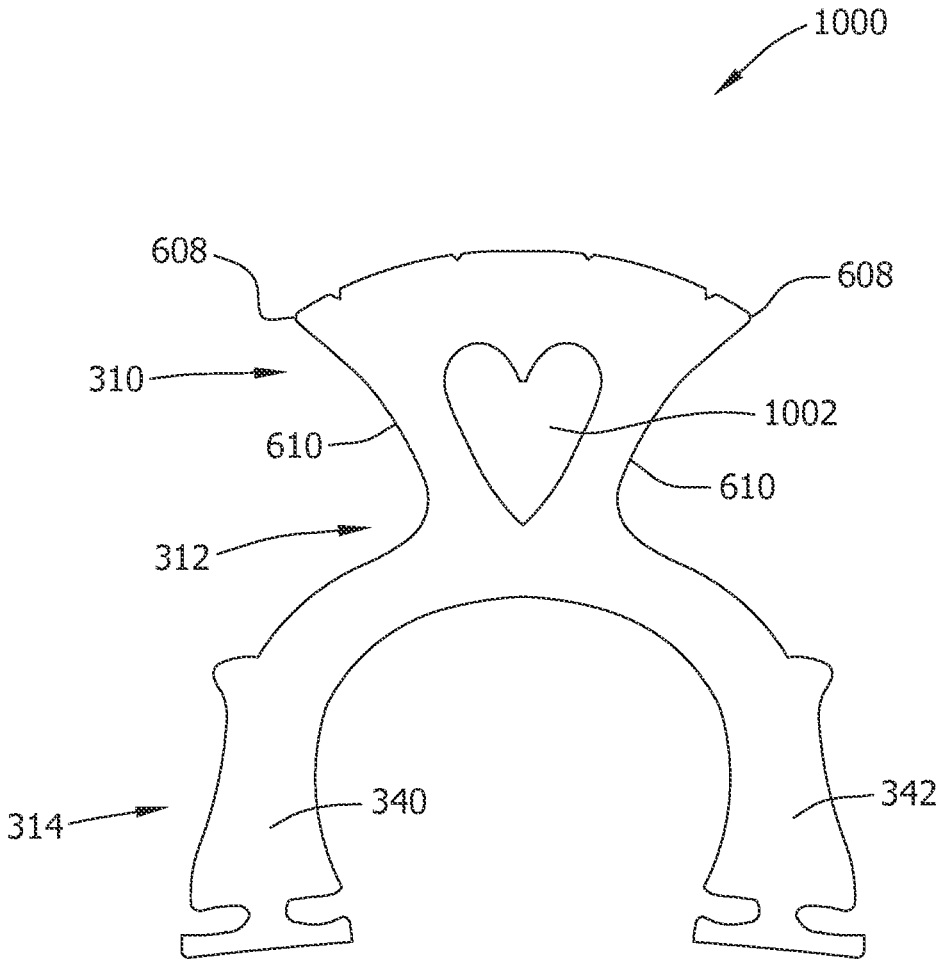
Figure 16:
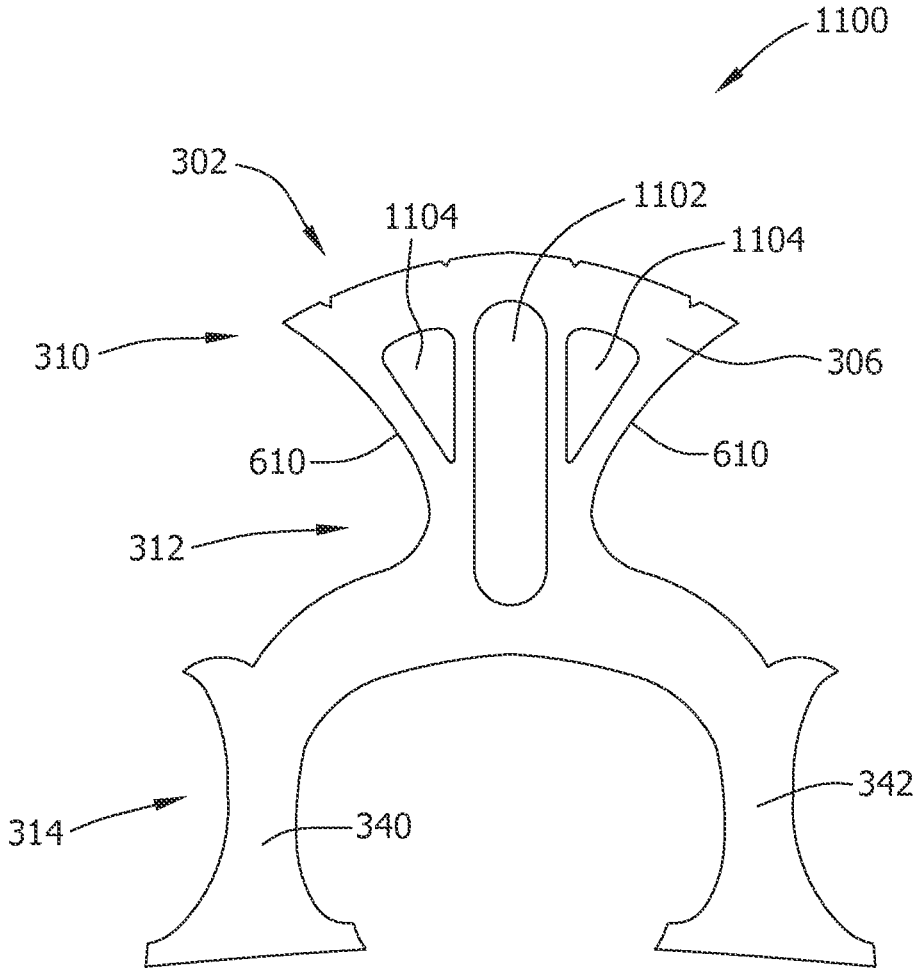

FIGS. 14-16 illustrate alternative shapes for recesses 318 and/or 320 and/or adjustment area 308. The different shapes can be selected to increase a weight of or decrease a weight of bridge 302 and/or to allow only certain movements of weight assembly 304. Further, although FIGS. 14-27 illustrate cello bridges, it should be understood that the descriptions below apply equally to violin, viola, and/or bass bridges. Moreover, the embodiments described herein are not limited to cellos and/or violins.

FIG. 14 is a front view of a second alternative cello variable tone device 900 that may be used with cello 150 (shown in FIG. 4) as bridge 158 (shown in FIG. 4). Unless otherwise described, cello variable tone device 900 includes components that are similar to the components described above with reference to cello variable tone device 600 (shown in FIG. 11). More specifically, cello variable tone device 900 includes a "T"-shaped adjustment area 902. T-shaped adjustment area 902 allows vertical and horizontal movement of weight assembly 304 (shown in FIGS. 7, 8, and 11), but such movement is more restricted than the movement allowed by adjustment area 308 (shown in FIGS. 7 and 11).

FIG. 15 is a front view of a third alternative cello variable tone device 1000 that may be used with cello 150 (shown in FIG. 4) as bridge 158 (shown in FIG. 4). Unless otherwise described, cello variable tone device 1000 includes components that are similar to the components described above with reference to cello variable tone device 300 (shown in FIGS. 7 and 8) and cello viable tone device 600 (shown in FIG. 11). More specifically, cello variable tone device 1000 includes a generally heart-shaped adjustment area 1002 rather than adjustment area 308 (shown in FIGS. 7 and 11). Adjustment area 308 can be formed by combining T-shaped adjustment area 902 (shown in FIG. 14) and heart-shaped adjustment area 1002.

FIG. 16 is a front view of a fourth alternative cello variable tone device 1100 that may be used with cello 150 (shown in FIG. 4) as bridge 158 (shown in FIG. 4). Unless otherwise described, cello variable tone device 1100 includes components that are similar to the components described above with reference to cello variable tone device 300 (shown in FIGS. 7 and 8) and/or cello variable tone device 600 (shown in FIG. 11). More specifically, cello variable tone device 1100 includes a generally "I"-shaped adjustment area 1102. I-shaped adjustment area 1102 allows vertical movement of weight assembly 304 (shown in FIGS. 7, 8, and 11), but such vertical movement is more restricted than the vertical movement allowed by adjustment area 308 (shown in FIGS. 7 and 11).

Further, cello variable tone device 1100 includes at least one aperture 1104 defined through body 306. In the exemplary embodiment, cello variable tone device 1100 includes two substantially symmetric apertures 1104 defined through body 306 to balance bridge 302 while reducing the total weight of bridge 302.

Figure 17:
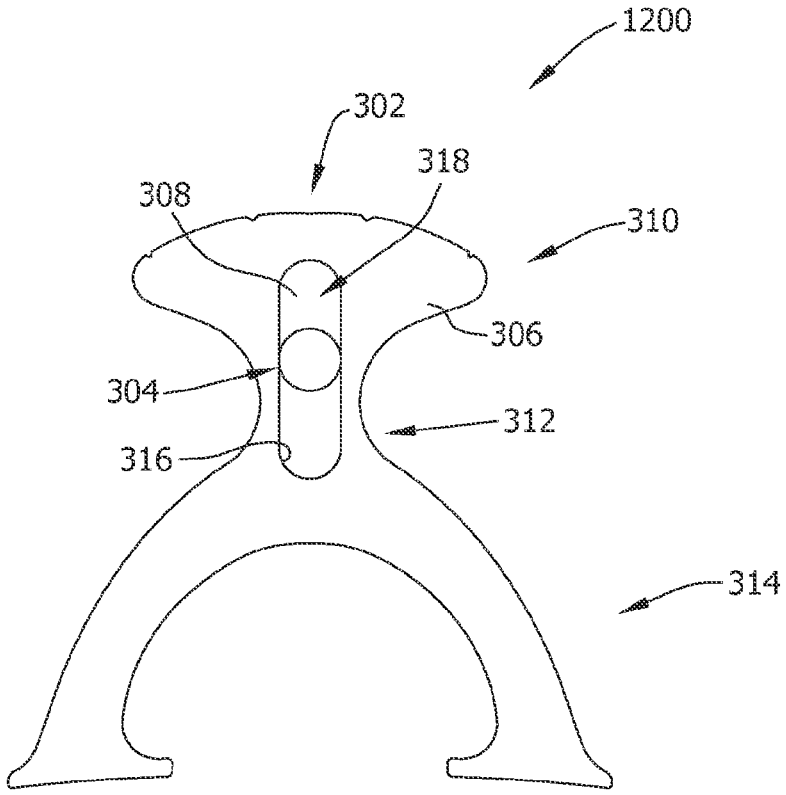
Figure 18:
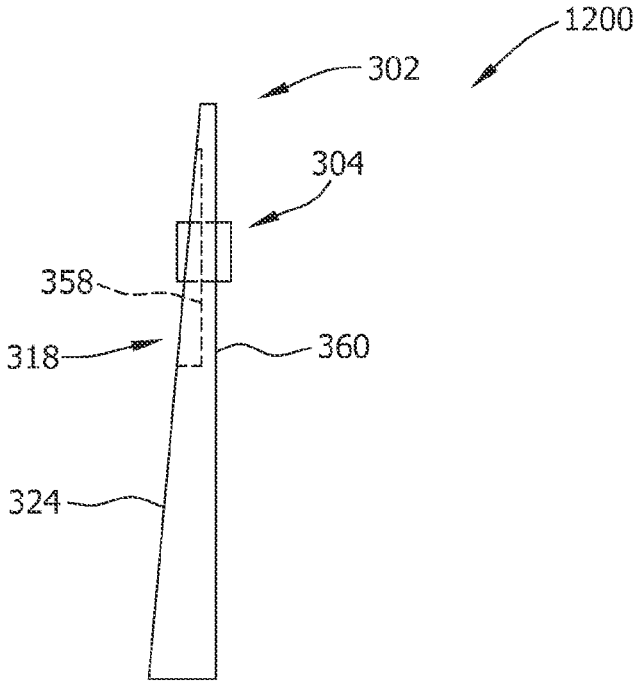

FIG. 17 is a front view of a fifth alternative cello variable tone device 1200 that may be used with cello 150 (shown in FIG. 4) as bridge 158 (shown in FIG. 4). FIG. 18 is a side view of cello variable tone device 1200. Unless otherwise described, cello variable tone device 1200 includes components that are similar to the components described above with reference to cello variable tone device 600 (shown in FIG. 11). More specifically, cello variable tone device 1200 includes only first recess 318 defined in front surface 324 of bridge 302. In the exemplary embodiment, recess 318 and adjustment area 308 are "I"-shaped rather than wide-band shaped as in FIG. 11.

Figure 19:
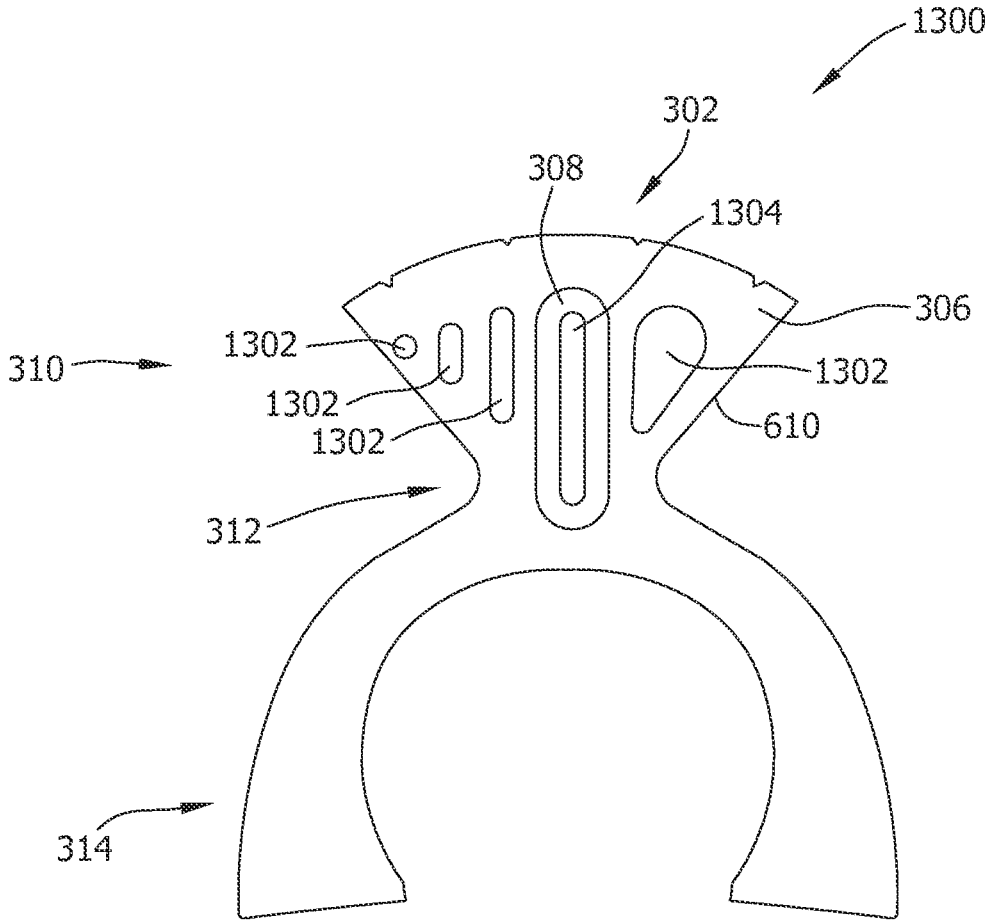

FIG. 19 is a front view of a sixth alternative cello variable tone device 1300 that may be used with cello 150 (shown in FIG. 4) as bridge 158 (shown in FIG. 4). Unless otherwise described, cello variable tone device 1300 includes components that are similar to the components described above with reference to cello variable tone device 600 (shown in FIG. 11). More specifically, cello variable tone device 1300 includes a plurality of apertures 1302 and 1304 defined through bridge 302 to reduce a total weight of bridge 302. In the exemplary embodiment, cello variable tone device 1300 includes a plurality of first apertures 1302 defined through body 306, and at least one second aperture 1304 defined through adjustment area 308. Second aperture 1304 is shaped and sized to correspond to a shape of adjustment area 308, which is illustrated in FIG. 19 is being "I"-shaped. Although specifically shaped and positioned apertures 1302 and 1304 are illustrated in FIG. 19, it should be understood that apertures 1302 and/or 1304 may have any suitable size, shape, and/or position that enables cello variable tone device 1300 to function as described herein.

Figure 20:
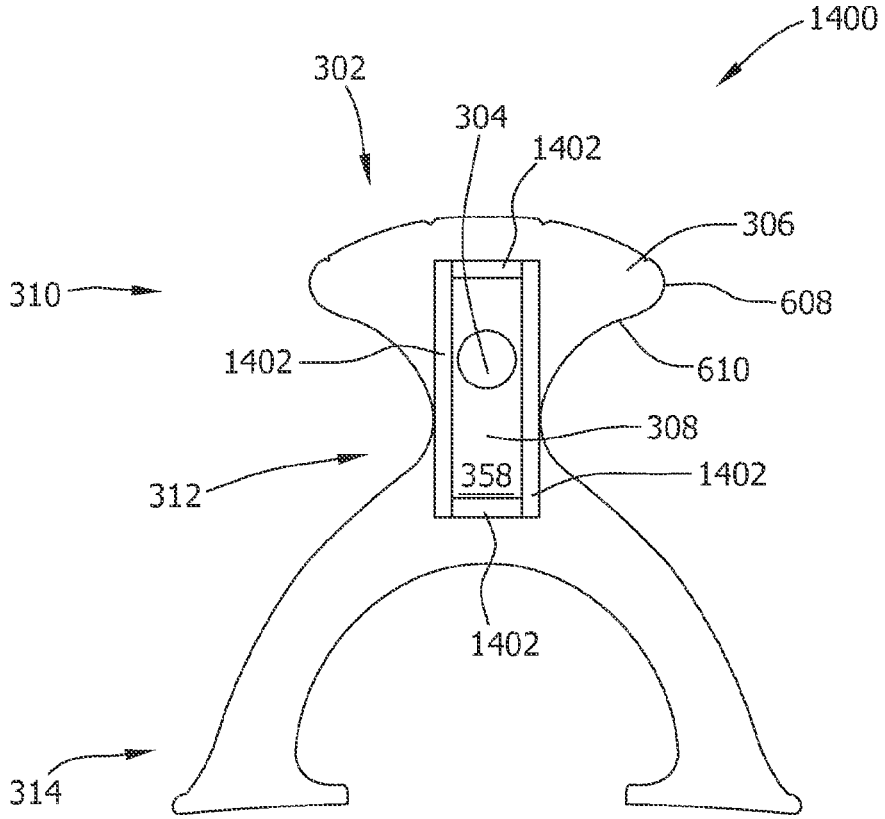
Figure 21:
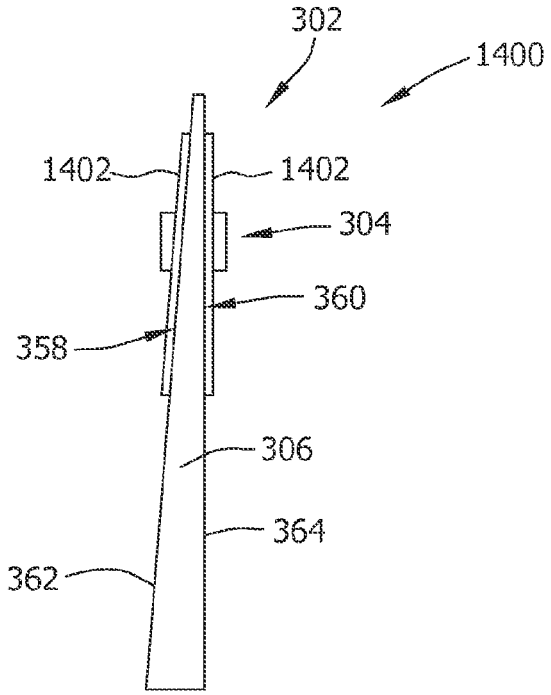

FIG. 20 is a front view of a seventh alternative cello variable tone device 1400 that may be used with cello 150 (shown in FIG. 4) as bridge 158 (shown in FIG. 4). FIG. 21 is a side view of cello variable tone device 1400. Unless otherwise described, cello variable tone device 1400 includes components that are similar to the components described above with reference to cello variable tone device 600 (shown in FIG. 11). More specifically, cello variable tone device 1400 includes raised strips 1402 to define adjustment area 308 rather than including recesses 318 and 320. In the exemplary embodiment, rather than being recessed from surfaces 362 and 364 of body 306, front surface 358 of adjustment area 308 is substantially flush with front surface 362 of body 306 and back surface 360 of adjustment area 308 is substantially flush with back surface 364 of body 306. Further, rather than forming an opening or recesses to define adjustment area 308, raised strips 1402 are coupled to front surface 362 and/or back surface 364 of body 306 to define adjustment area 308. Strips 1402 retain weight assembly 304 within adjustment area 308 during use.

Figure 22:
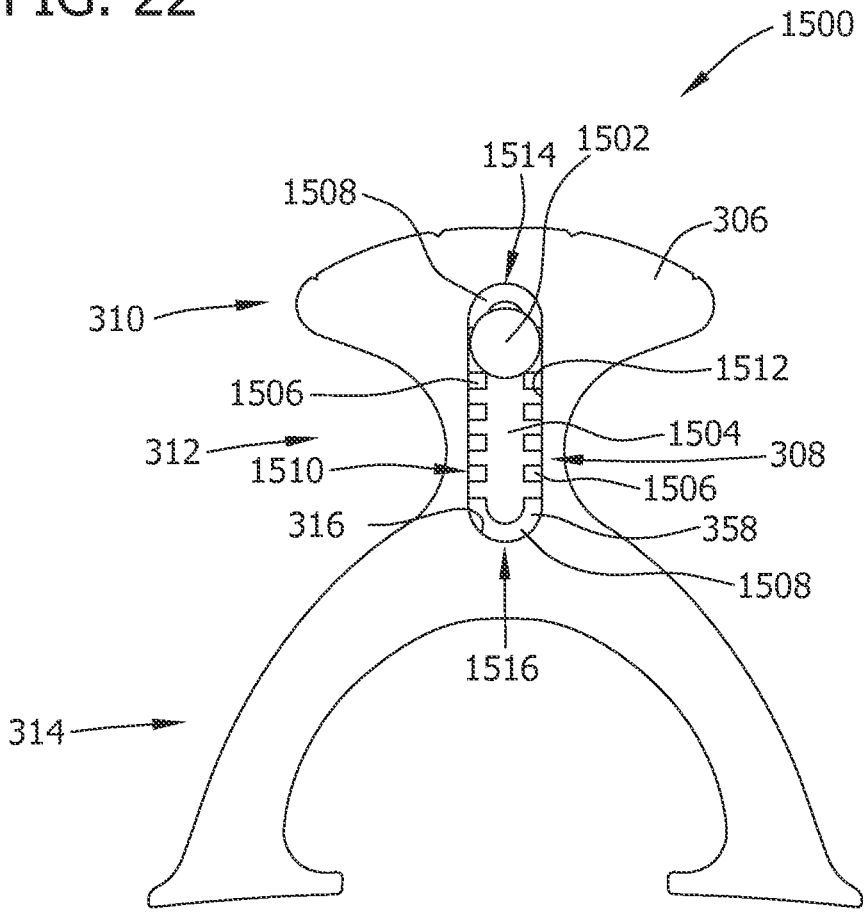
Figure 23:
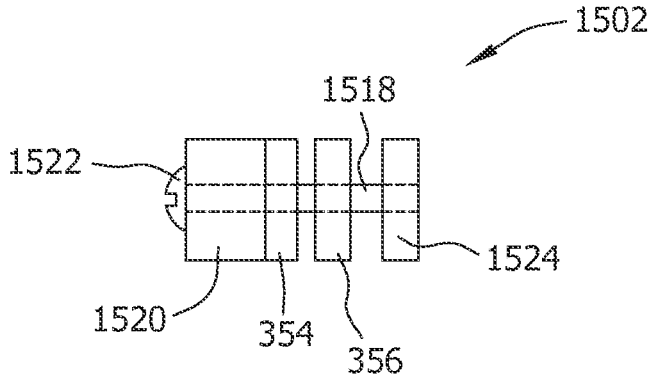

FIG. 22 is a front view of an eighth alternative cello variable tone device 1500 that may be used with cello 150 (shown in FIG. 4) as bridge 158 (shown in FIG. 4). FIG. 23 is a side view of a weight assembly 1502 that may be used with cello variable tone device 1500. Unless otherwise described, cello variable tone device 1500 includes components that are similar to the components described above with reference to cello variable tone device 600 (shown in FIG. 11).

More specifically, adjustment area 308 of cello variable tone device 1500 includes an opening 1504 defined therethrough and discrete projections 1506 and stops 1508 of material rather than having a continuous portion of material positioned within body 306. In the exemplary embodiment, opening 1504 is generally "I"-shaped, however, opening 1504 can have any suitable shape that enables device 1500 to function as described herein. Within opening 1504, pairs 1510 of projections 1506 are positioned along an edge 1512 of opening 1504 and stops 1508 are positioned at a top 1514 of opening 1504 and a bottom 1516 of opening 1504. Edge 1512 of opening 1504 can also be considered inner edge 316 of body 306. In the exemplary embodiment, projections 1506 and stops 1508 have a thinner thickness than body 306 to form at least one small recess 318 and/or 320. Alternatively, projections 1506 and/or stops 1508 have substantially the same thickness as body 306.

Further, cello variable tone device 1500 includes weight assembly 1502 rather than weight assembly 304 (shown in FIGS. 7, 8, and 11). Weight assembly 1502 includes first magnet 354 and second magnet 356 coupled to a rod 1518, such as, without limitation, a dowel, a screw, and/or a bolt. In the exemplary embodiment, first magnet 354 is fixedly coupled to rod 1518. A spacer 1520 may be used to fixedly couple first magnet 354 to rod 1518, or first magnet 354 may be positioned directly adjacent an end stop 1522, such as a head of a screw. In the exemplary embodiment, second magnet 356 moves freely along rod 1518, and is prevented from accidentally being removed from rod 1518 by an end stop 1524. In one embodiment, end stop 1524 is removably coupled to rod 1518.

To assemble cello variable tone device 1500, end stop 1524 and second magnet 356 are removed from rod 1518 and rod 1518 is inserted through opening 1504 such that first magnet 354 is adjacent front surface 358. Second magnet 356 is then positioned on rod 1518, and end stop 1524 is permanently or removably coupled to rod 1518. During use, the player slightly pulls first magnet 354 outward, and slides weight assembly 1502 within opening 1504. Spacer 1520 may assist the player in pulling or grasping weight assembly 1502. Each pair 1510 of projections 1506 acts as a stop to facilitate positioning weight assembly 1502 with respect to bridge 302. Once weight assembly 1502 is at a desired position, the player releases first magnet 354, and second magnet 356 is pulled along rod 1518 into contact with projections 1506, stop 1508, and/or first magnet 354 by magnetic attraction.

Figure 24:
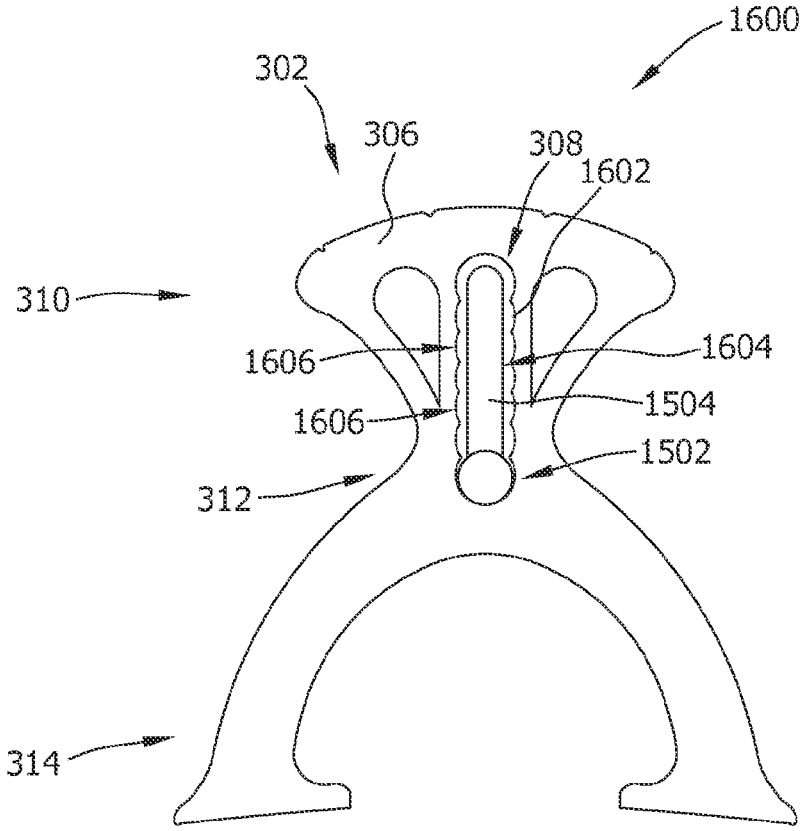
Figure 25:
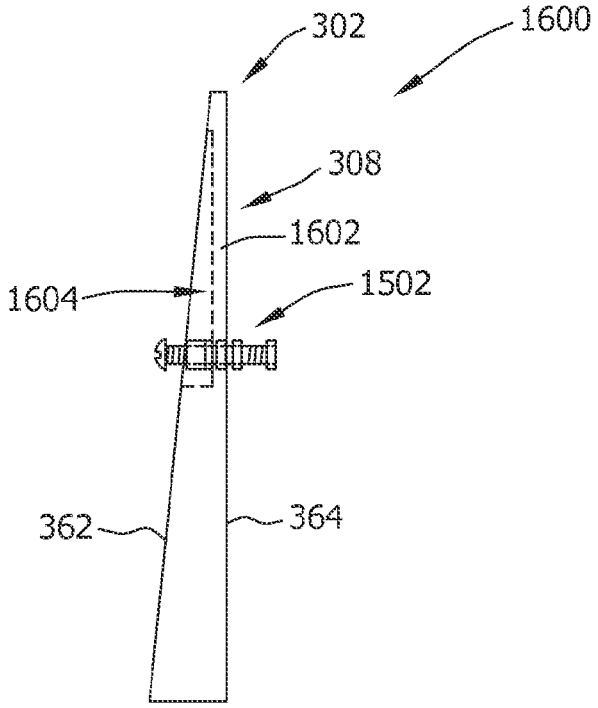

FIG. 24 is a front view of a ninth alternative cello variable tone device 1600 that may be used with cello 150 (shown in FIG. 4) as bridge 158 (shown in FIG. 4). FIG. 25 is a side view of cello variable tone device 1600. Unless otherwise described, cello variable tone device 1600 includes components that are similar to the components described above with reference to cello variable tone device 1500 (shown in FIGS. 22 and 23).

More specifically, adjustment area 308 of cello variable tone device 1600 includes opening 1504 defined therethrough and a dimpled platform 1602 rather than having a continuous portion of material positioned within body 306. In the exemplary embodiment, opening 1504 is generally "I"-shaped, however, opening 1504 can have any suitable shape that enables device 1600 to function as described herein. Within opening 1504, dimpled platform 1602 is formed by a dimpled recess 1604 defined in front surface 362 of body 306. A similar dimpled recess may additionally or alternatively be defined in back surface 364 of body 306.

In the exemplary embodiment, cello variable tone device 1600 includes weight assembly 1502 (shown in FIG. 23). During use, the player slightly pulls first magnet 354 outward, and slides weight assembly 1502 within opening 1504. Each dimple 1606 defined by dimpled platform 1602 and/or dimpled recess 1604 acts as a stop to facilitate positioning weight assembly 1502 with respect to bridge 302. Once weight assembly 1502 is at a desired position, the player releases first magnet 354, and second magnet 356 is pulled along rod 1518 into contact with dimpled platform 1602 and/or first magnet 354 by magnetic attraction.

Figure 26:
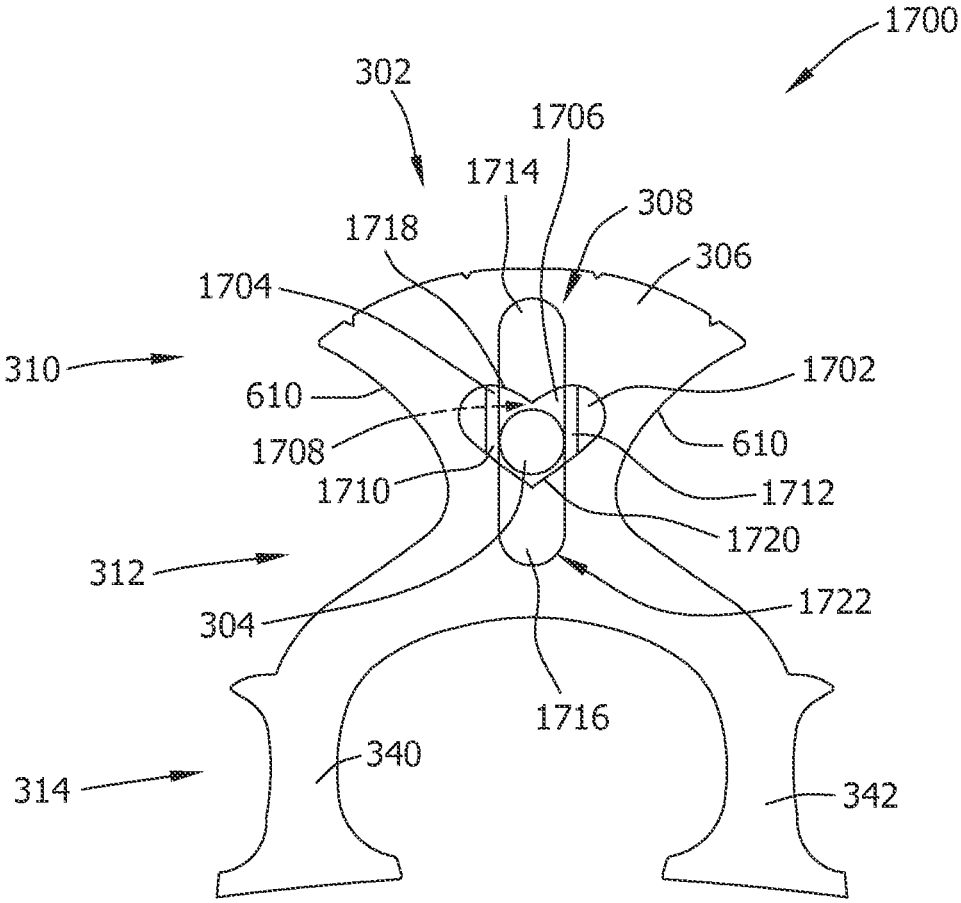

FIG. 26 is a front view of a tenth alternative cello variable tone device 1700 that may be used with cello 150 (shown in FIG. 4) as bridge 158 (shown in FIG. 4). Unless otherwise described, cello variable tone device 1700 includes components that are similar to the components described above with reference to cello variable tone device 300 (shown in FIGS. 7 and 8) and/or cello variable tone device 600 (shown in FIG. 11).

More specifically, cello variable tone device 1700 includes adjustment area 308 that includes an opening 1702 defined through body 306 and an insert 1704 coupled within opening 1702. As such, insert 1704 is shaped to correspond to a shape of opening 1702. In the exemplary embodiment, opening 1702 is generally heart-shaped, however, opening 1702 may have any suitable shape that enables cello variable tone device 1700 to function as described herein. Insert 1704 has an I-shaped cross-sectional shape defined by a front slot 1706 and a rear slot 1708. Alternatively, insert 1704 has a U-shaped cross-sectional shape defined by front slot 1706 or rear slot 1708. In the exemplary embodiment, slots 1706 and 1708 define side rails 1710 and 1712. Adjustment area 308 further includes an upper recess 1714 and a lower recess 1716 that extends from a top end 1718 of insert 1704 and a bottom end 1720 of insert 1704, respectively. Recesses 1714 and 1716 and slot 1706 form a front channel 1722. Additionally or alternatively, a rear channel is also formed by defining upper and lower recesses 1714 and 1716 in back surface 326 (shown in FIG. 8) of body 306.

During use, first magnet 354 is positioned in front channel 1722, and second magnet 356 is positioned in the rear channel. A position of weight assembly 304 can be adjusted within the channels as described herein.

Figure 27:
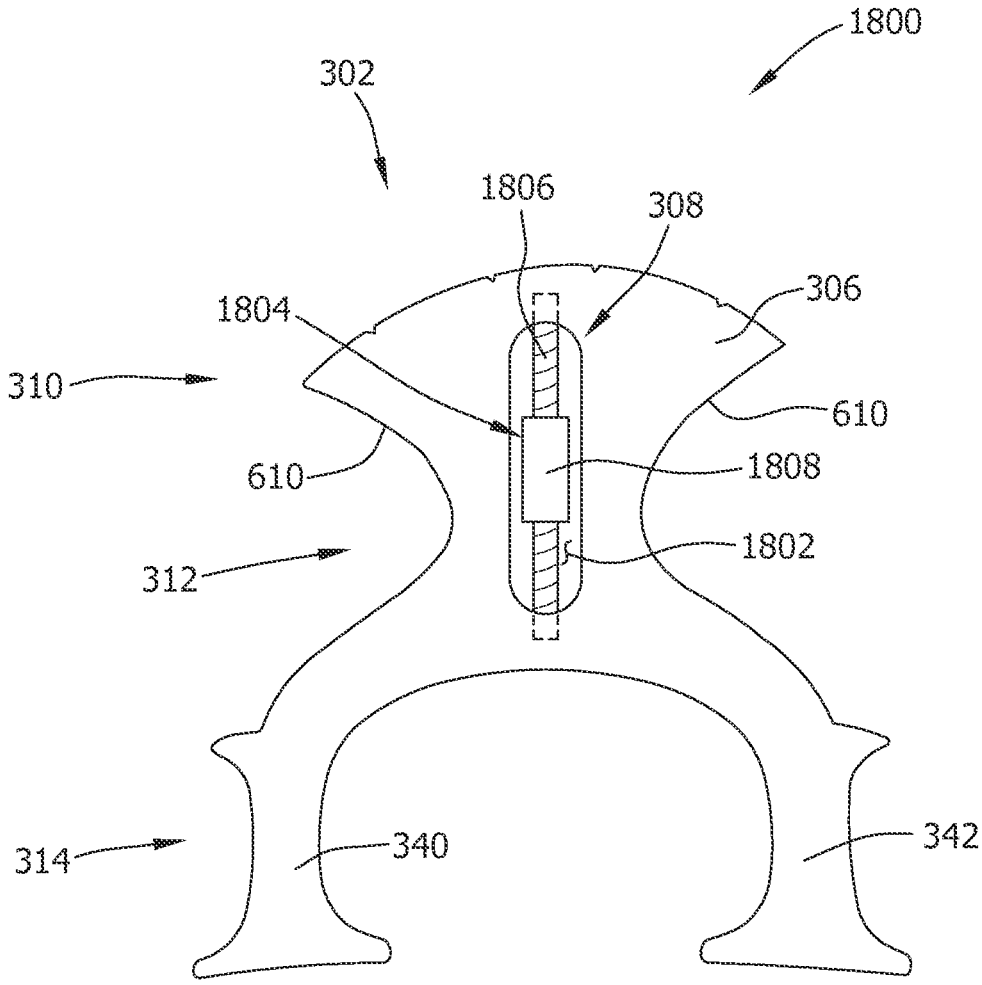

FIG. 27 is a front view of an eleventh alternative cello variable tone device 1800 that may be used with cello 150 (shown in FIG. 4) as bridge 158 (shown in FIG. 4). Unless otherwise described, cello variable tone device 1800 includes components that are similar to the components described above with reference to cello variable tone device 300 (shown in FIGS. 7 and 8) and/or cello variable tone device 600 (shown in FIG. 11).

More specifically, cello variable tone device 1800 includes adjustment area 308 having an opening 1802 and a weight assembly 1804 positioned within opening 1802. In the exemplary embodiment, opening 1802 is a generally "I"-shaped vertical opening, however, opening 1802 can have any suitable shape, such as, without limitation, an "I"-shaped horizontal opening. In the exemplary embodiment, weight assembly 1804 includes a rod 1806 and a weight 1808 adjustably coupled to rod 1806. In a particular embodiment, rod 1806 is threaded and weight 1808 is adjustable on rod 1806 by rotating weight 1808 with respect to rod 1806.

Any of the following modifications and/or alternations may be applied to any of the above-described embodiments: (1) weights can be attached to a bridge using an adhesive for substantially permanent modification of the tone; (2) weights can be attached to the bridge with a screw, nut, bolt, and/or pin; (3) weights can be attached to the bridge using an adjustable and/or reusable fastening device, such as hook-and-loop fasteners; (4) weights can be attached to the bridge using a sticky substance, such as putty; and (5) weights can be attached to the bridge using magnets and/or a threaded screw.

The above-described embodiments allow a musician to selectably change a voicing of an instrument at will and to make such a change within a few seconds. By using the embodiments described herein, a musician can avoid the inconvenience of the trial and error method of changing various strings from different manufacturers and/or the expense of taking the instrument to a luthier to move the soundpost, which ultimately may or may not improve the sound. With the variable tone devices described herein, when the sound post and the bridge are secured in standard position, and the musician can move a magnet or weight assembly on the bridge to "tune" the instrument for a wide range of tone or timber to match the player's taste. Once the musician has found a desired position for the weights, the musician can leave the weights in that position most of the time. The weights will remain in the desired position unless they are shifted due to accidental rough handling. However if accidental re-positioning occurs, the weights can easily be repositioned back to the desired position.

Further, it is known that some concert master instruments have a brighter timber or tone than the usual concert instrument because the concert master usually prefers to hear his or her instrument above the sound of the rest of the orchestra. This is also true of a soloist. Using the above-described variable tone device, an instrument's sound can conveniently be changed from bright to mellow and back again as needed. As such, the same instrument, as fitted with the variable tone device described herein, can serve both as a solo instrument (brighter) and serve as an orchestral instrument (mellower) by moving the weights on the bridge.

Moreover, to change the timber of an instrument from bright to mellow is less complicated using the embodiments described herein as compared to attaching a mute to the bridge. This is because the mute must be mechanically clipped onto the bridge or removed from the bridge as called for by the musical script. In contrast, if the script calls for a warmer sound, the weight on a variable tone device is already attached to the bridge and only needs to be moved to a higher position. Assuming that an entire string section of an orchestra is fitted with the variable tone devices described herein, the string section can be "tuned" to a mellow or bright timber or tone as required by the taste of the conductor. Thus orchestral timber tuning can be changed from section to section within a musical piece and/or changed from one musical piece to the next musical piece. Accordingly, the conductor has greater freedom to change the mood of the music and/or to create a more lush orchestral sound by modifying the orchestra's tone or timber.

Exemplary embodiments of a tone control device for use with a musical instrument and method for making the same are described above in detail. The methods and devices are not limited to the specific embodiments described herein, but rather, components of devices and/or steps of the methods may be utilized independently and separately from other components and/or steps described herein. For example, the weight assemblies may also be used in combination with other instruments and methods, and are not limited to practice with only the stringed instruments and methods as described herein. Rather, the exemplary embodiment can be implemented and utilized in connection with many other weight re-distribution applications.

Although specific features of various embodiments of the invention may be shown in some drawings and not in others, this is for convenience only. In accordance with the principles of the invention, any feature of a drawing may be referenced and/or claimed in combination with any feature of any other drawing.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

What is claimed is:

1. A tone control device for use with a musical instrument having a bridge, said tone control device comprising:

a weight assembly comprising:

a first magnet selectively positionable on a first surface of the bridge, and a second magnet magnetically attracted to the first magnet and selectively positionable on a second surface of the bridge opposite the first surface such that a magnetic attraction between the first magnet and the second magnet enables the weight assembly to be coupled to the bridge.

2. A tone control device in accordance with claim 1, wherein the weight assembly is movable along the bridge within an adjustment area of the bridge to facilitate redistributing a weight of the bridge.

3. A tone control device in accordance with claim 1, wherein the weight assembly is movable horizontally and vertically with respect to the bridge.

4. A tone control device in accordance with claim 1, wherein the weight assembly comprises a rod extending through an aperture defined in an adjustment area of the bridge and between the first magnet and the second magnet.

5. A tone control device in accordance with claim 1, wherein at least one of the first magnet and the second magnet is coupled to the bridge using an adhesive.

6. A tone control device in accordance with claim 1, wherein at least one of the first magnet and the second magnet is coupled to the bridge using a sticky substance.

7. A musical instrument comprising:

a bridge comprising an adjustment area, the bridge configured to retain a plurality of strings of the musical instrument thereon; and a weight assembly comprising a first magnet selectively positionable on a first surface of the bridge, and a second magnet magnetically attracted to the first magnet and selectively positionable on a second surface of the bridge opposite the first surface such that a magnetic attraction between the first magnet and the second magnet enables the weight assembly to be coupled to the bridge.

8. A musical instrument in accordance with claim 7, wherein the weight assembly is movable along the bridge within the adjustment area to facilitate redistributing a weight of the bridge.

9. A musical instrument in accordance with claim 7, wherein the adjustment area has a wide-band shape that enables the weight assembly to be moved horizontally and vertically with respect to the bridge.

10. A musical instrument in accordance with claim 7, wherein at least one of the first magnet and the second magnet is coupled to the bridge using an adhesive.

11. A musical instrument in accordance with claim 7, wherein at least one of the first magnet and the second magnet is coupled to the bridge using a sticky substance.

12. A musical instrument comprising:

a bridge comprising an adjustment area, the bridge configured to retain a plurality of strings of the musical instrument thereon; and a weight assembly comprising at least a first magnet coupled to the bridge, and a second magnet opposite the first magnet such that a magnetic attraction between the first magnet and the second magnet enables the second magnet to be coupled to the bridge, wherein the adjustment area has a wide-band shape that enables the first magnet to be selectively moved horizontally and vertically with respect to the bridge.

13. A musical instrument in accordance with claim 12, wherein the weight assembly is movable along the bridge within the adjustment area to facilitate redistributing a weight of the bridge.

14. A musical instrument in accordance with claim 12, wherein the first magnet is selectively positionable on a first surface of the bridge and the second magnet is selectively positionable on a second surface of the bridge opposite the first surface.

15. A musical instrument in accordance with claim 14, wherein the second magnet is coupled to the bridge using an adhesive.

16. A musical instrument in accordance with claim 14, wherein the second magnet is coupled to the bridge using a sticky substance.

17. A method for making a tone control device for use with a musical instrument, the method comprising:

selectively positioning a first magnet on a first surface of a bridge; and selectively positioning a second magnet on a second surface of the bridge opposite the first surface such that a magnetic attraction between the first magnet and the second magnet enables the first and second magnets to be coupled to the bridge.

18. A method for making a tone control device for use with a musical instrument, said method comprising:

forming an adjustment area within a bridge blank, the bridge blank at least partially defining a body of a bridge; and providing a weight assembly comprising at least a first magnet configured to be movable along the bridge to redistribute a weight of the bridge, and a second magnet opposite the first magnet such that a magnetic attraction between the first magnet and the second magnet enables the second magnet to be coupled to the bridge, wherein the adjustment area has a wide-band shape that enables the first magnet to be selectively moved horizontally and vertically with respect to the bridge.

19. A tone control device for use with a musical instrument having a bridge, said tone control device comprising:

a weight assembly comprising:

a first object selectively positionable on a first surface of the bridge, and a second object selectively positionable on a second surface of the bridge opposite the first surface, the second object magnetically attracted to the first object, such that a magnetic attraction between the first object and the second object enables the weight assembly to be coupled to the bridge.

* * * * *